US006694038B1

(12) United States Patent
Azima

(10) Patent No.: US 6,694,038 B1
(45) Date of Patent: Feb. 17, 2004

(54) ACOUSTIC DEVICE

(75) Inventor: Henry Azima, Cambridge (GB)

(73) Assignee: New Transducers Limited, London (GB)

( * ) Notice: Subject to any disclaimer, the term of this patent is extended or adjusted under 35 U.S.C. 154(b) by 0 days.

(21) Appl. No.: 09/386,361

(22) Filed: Aug. 31, 1999

Related U.S. Application Data

(63) Continuation-in-part of application No. 08/707,012, filed on Sep. 3, 1996, now Pat. No. 6,332,029.

(30) Foreign Application Priority Data

Sep. 2, 1998 (GB) ..... 9818959

(51) Int. Cl.[7] ..... H04R 1/00

(52) U.S. Cl. ..... 381/423; 381/152; 381/424; 381/431

(58) Field of Search ..... 381/152, 423, 381/424, 425, 426, 431, 398; 181/171, 172, 174

(56) References Cited

U.S. PATENT DOCUMENTS 4,847,908 A * 7/1989 Nieuwendijk et al. ..... 181/174

* cited by examiner

*Primary Examiner*—Huyen Le
(74) *Attorney, Agent, or Firm*—Foley & Lardner

(57) ABSTRACT

A panel form acoustic member capable of supporting bending wave vibration has the bending wave velocity varied in the region of coincidence to provide a range of coincidence frequencies, for causing the acoustic coupling of the bending waves in the panel to occur over a broader range of angles or for making the coupling more uniform. The member may be incorporated in a loudspeaker having a panel member (1) and an exciter (3) fixed to the panel member to excite bending waves in the loudspeaker to cause an acoustic output.

19 Claims, 24 Drawing Sheets

(a)

(b)

10mm flat panel

SPL: smoothed- f=6200Hz

SPL: smoothed- f=10kHz

SPL: smoothed- f=13kHz

Tapered panel

SPL: smoothed- f=6200Hz

SPL: smoothed- f=10kHz

SPL: smoothed- f=13kHz

10mm flat panel

Tapered panel

ACOUSTIC DEVICE

This application is a continuation-in-part of application Ser. No. 08/707,012, filed Sep. 3, 1996 now U.S. Pat. No. 6,332,029.

DESCRIPTION

The invention relates to panel form acoustic apparatus using bending wave modes and in particular to loudspeakers incorporating such panels.

Distributed mode acoustic devices are known from copending parent application Ser. No. 08/707,012, which is incorporated herein by reference in its entirety. Such devices do not operate by moving a diaphragm backwards and forwards (pistonically) in the manner of normal loudspeakers. Instead, a transducer is coupled to a stiff panel capable of bending wave oscillations. The bending wave oscillations are distributed over the required frequency range, and couple to the air. The technology is often used in loudspeakers, in which case the transducer is an exciter that excites bending wave oscillations in the panel resulting in an acoustic output.

In WO98/39947, a document that was published after the priority date of the present application, a distributed mode acoustic device is described that can also be operated pistonically. In order to arrange for the centre of mass to be at a suitable exciter location, the distribution of bending stiffness is arranged such that the centre of bending stiffness is offset from the exciter position It is often advantageous to use a large stiff panel. Large stiff panels give a good high and low frequency performance. However, above the coincidence frequency, at which frequency the speed of propagation of bending waves matches the speed of sound in air, strong beaming can occur.

In smaller panels the effects of coincidence are less of a problem. However, the reduction in size attenuates the low frequency performance and reduces the modal density at lower frequencies, making the response less even.

It is also possible to use a less stiff panel to reduce coincidence effects. This may harm the high frequency performance in two ways. Firstly, the coil mass may have a stronger influence as its impedance becomes comparable to the panel impedance at a lower frequency, affecting high frequency roll-off. Secondly, the aperture resonance of the panel material inside the voice coil, which occurs when the panel wavelength is comparable to the exciter diameter, takes place at a lower frequency for a less stiff panel. This effect can be evident as a peak in the sound pressure. In addition the low frequency performance of a large panel of lower stiffness is relatively poor.

According to the invention there is provided a panel form acoustic member capable of supporting bending wave vibration, wherein the bending wave velocity in the panel is specifically varied in the region of coincidence to produce a range of coincidence frequencies so that acoustic coupling of the bending waves in the panel to the sound waves in ambient air occurs over a broader range of angles and/or so that the acoustical power coupling to the ambient air is more uniform.

The control of coincidence is not a subject of theory or textbook teaching. Although the coincidence effect is known it is treated as a difficulty to be avoided. Alternative methods teach adding mass to the member or coupled layer damping and are generally isotropic treatments.

The panel form acoustic member may be incorporated in any of a number of possible acoustic devices. Accordingly, there may be provided an acoustic absorber, an acoustic resonator for reverberation control, an acoustic enclosure, or a support for audio components including such a panel form acoustic member.

A particularly important application is to a loudspeaker. Accordingly, there may be provided a loudspeaker comprising a panel member capable of supporting bending waves in the audio frequency range, an exciter on the panel member for exciting bending waves in the panel to produce an acoustic output, wherein the bending stiffness of the panel member varies with position over the area of the panel member, so that the effect of coincidence on the acoustic output of the panel is smoothed.

The effects of coincidence on the acoustic output include beaming of sound above the coincidence frequency or discontinuities or peaks in the sound output pressure or power as a function in frequency, integrated over the whole forward hemisphere and/or in particular directions. Using the invention, any or all of these effects may be reduced.

A variation of bending stiffness causes an additional change in the velocity of sound in the panel and hence a variation of the coincidence frequency. The direction of acoustic radiation may accordingly vary over the surface of the panel. The variation of bending stiffness may thus be arranged to cause the distribution of the radiated sound to be spread over a larger angle, to reduce beaming.

Further, in a bending wave panel the power output as a function of frequency often has a peak, step or discontinuity at the coincidence frequency. This irregularity may be smoothed by varying the coincidence frequency.

The coincidence frequency is inversely related to the bending stiffness, and may normally be varied by varying the bending stiffness. This in turn can be achieved by varying the thickness of the panel.

The panel may be stiffer at the exciter location since the aperture resonance caused by a coupling of the coil mass over a finite area is at an advantageously higher frequency for a stiffer panel.

Alternatively, the bending stiffness may have a maximum near the exciter position. For example, the panel can be made symmetric with a maximum in its centre so that the preferred off-centre exciter position for distributed mode panels is close to, but not at, the minimum of coincidence frequency, normally the maximum of bending stiffness. By "close to" is meant sufficiently close that the bending stiffness at the exciter is at least 70% of its maximum; preferably 80% and further preferably 90% higher.

In other embodiments, the panel may be stiffer at the edges of the panel than the centre. The coincidence frequency is still smoothed by the variation in stiffness.

The exciter may be located on the thin region of the panel, where the mechanical impedance of the panel is less. This can aid coupling of lower frequency energy into the panel.

The panel may have a maximum bending stiffness within the central region (the central third both across and along the panel) and reduce in stiffness towards the edges. Such a panel may be formed by injection moulding by gating from the thicker central region of the panel.

The invention may provide the benefits of a large stiff panel whilst reducing some of the disadvantages, in particular the effects of a coincidence frequency within the audio range.

However, the invention is not only applicable to large stiff panels and some good results, presented below, have been obtained on small panels.

In order to have an effect on coincidence, the bending stiffness has to vary over a region of the panel of linear dimension comparable or greater than the wavelength of sound in the frequency range of interest. This may typically be 3 to 4 cm for a frequency of 10 kHz. A very small area of increased bending stiffness is accordingly not suitable to smooth the effects of coincidence. Variation over an area of linear size at least 1.5 times, preferably double the wavelength at coincidence is thus suitable. A variation over an area of at least 5% of the panel area, preferably 10%, may be beneficial for reducing coincidence effects.

Subject to the caveats of the previous paragraph, the bending stiffness variation may be concentrated at the exciter position. For example, the gradient of bending stiffness may be high close to the exciter position and slowly reduce along lines extending outwards from the exciter position. In some embodiments, such a profile gives a useful smoothing of coincidence effects. The gradient can reduce to zero at the edge of the exciter region or the variation can extend to the edge of the panel.

The bending stiffness may be constant in the region of the panel far away from the exciter, with all of the variation of bending stiffness concentrated in the exciter region.

The bending stiffness may also be varied in a strip around the edge of the panel member. The bending stiffness may be maximum at the edge and reduce towards a level in the interior of the panel, or may be a minimum at the edge and increase. Such a panel may have its edge clamped in a frame: the variation of bending stiffness at the edge can then create a desired match or mismatch between the mechanical impedance of the panel and that of the clamping for further control of acoustic output.

The bending stiffness may in particular vary in the edge strip that is no more than a distance of 10% of the length of the panel from the edge.

A reduction in stiffness close to the panel edge reduces the mechanical impedance of the panel in the edge region. If this reduced impedance is less than that of a clamping frame little energy is transferred from the panel to the frame.

Similarly, an increase in peripheral stiffness will increase the mechanical impedance of the panel in that region. If the panel is supported on a resilient support then the increase in panel impedance may create a larger mismatch to minimise unwanted energy transfer to the frame. Conversely, if the panel is connected to a rigid clamp type frame, then this can provide a smoother transition from the panel to the clamped edge and so aid the mechanical robustness of the final construction.

Moreover, in either case a rapidly varying bending stiffness near the edge may reflect acoustic vibration energy back into the interior of the panel so little energy reaches the frame.

The bending stiffness may vary rapidly in the edge region and be relatively constant in the interior of the panel. Alternatively, the bending stiffness may vary over both the edge region and the interior. The bending stiffness may also vary both in the region of the exciter and around the edge, with a region of little or no stiffness variation between the edge and the exciter regions.

Another option is to vary the bending stiffness in an undulating pattern over the panel, or in a plurality of steps.

The coincidence frequency $f_c$, at which the speed of sound in air matches that in the panel, varies as $$f_c = \frac{c^2}{2\pi}\sqrt{\frac{\mu}{B}}$$

where c is the speed of sound in air, $\mu$ the areal density of the panel, and B the bending stiffness.

In fact, as well as or instead of varying the bending stiffness any parameter may be varied that changes the velocity in the panel and accordingly the coincidence frequency. Accordingly, it is possible to vary the Young's modulus of the skin, or the areal density of the skin or core.

In another aspect there may be provided a method of making an acoustical member capable of supporting bending wave vibration, wherein the wave velocity is specifically varied in the region of coincidence to produce a range of coincidence frequencies.

The method may further comprise the steps of selecting a panel material and panel size, selecting an initial bending stiffness profile of the panel, and iteratively varying the panel profile or tensile stiffness of the skin with area to improve the frequency and angle responses of the panel by varying the wave velocity in the panel at around the coincidence frequency to produce the range of coincidence frequencies. In the step of iteratively selecting the panel profile the distribution of resonant modes in the panel over frequency may also be optimised.

In yet another aspect of the invention, there is provided a method of making a loudspeaker system, comprising selecting a panel material, panel size, and exciter type, selecting an initial exciter position on the panel, selecting an initial bending stiffness profile of the panel, iteratively varying the exciter position and panel profile to select a position and profile that optimises the frequency and angle responses of the panel to reduce the effects of coincidence as compared with a flat panel, providing a panel of the iteratively selected panel profile, and affixing an exciter thereto at the iteratively selected position.

The size, profile and exciter position may be selected to produce a distributed mode loudspeaker in which the lower frequency modes are well distributed in frequency and in which the aperture effects are minimised at higher frequencies.

BRIEF DESCRIPTION OF THE DRAWINGS

Specific embodiments of the invention will now be described, purely by way of example, with reference to the accompanying drawings, in which:

FIG. 1 shows a loudspeaker comprising a panel (1) with an exciter (3) attached thereto. The exciter (3) excites resonant bending waves in the panel to cause the panel to emit sound. Electrical conductors (5) connect the exciter to an amplifier. The panel (1) is in this embodiment made from a core (7) and two skins (9). Alternatively, the panel may be monolithic.

Figure 1:
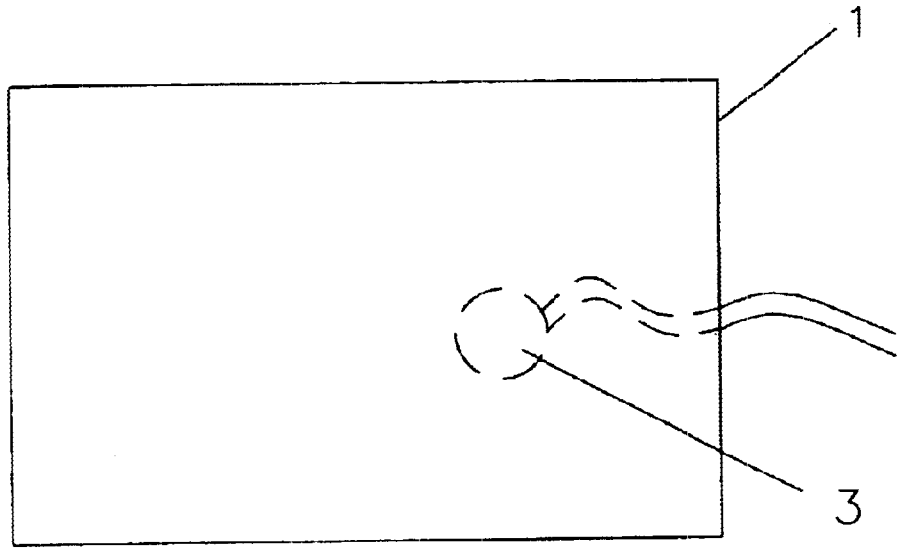
FIG. 1 illustrates a loudspeaker according to the invention.
Figure 1:
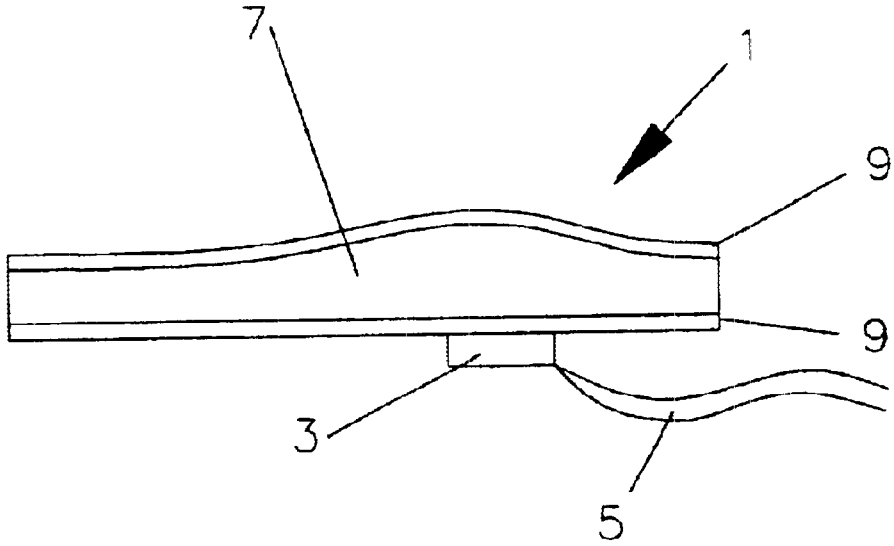

The panel used in the loudspeaker can be a distributed mode panel, as described in parent application Ser. No. 08/707,012, where a useful frequency response is achieved by distributing the resonant modes evenly in frequency, and it is advantageous if the modes are distributed over the panel.

For a good modal distribution of excited waves, the shape of the panel and exciter location can be selected. Some specific suitable shapes are taught in parent application Ser. No. 08/707,012, for example a rectangle of aspect ratio 1:0.882 or 1:0.707, for an isotropic panel. Some adjustment to these ratios may be required depending on the panel thickness profile.

The exciter locations are also important. The exciter position should couple to the distributed resonant modes. Some good exciter positions are located near but not at the centre of the panel. For an isotropic rectangular panel, one such position is at coordinates referred to the lengths of the sides of (3/7,4/9), close to the panel centre coordinates at (½,½). Of course, for panels with the variation of bending stiffness forseen in the present invention the preferred coordinates will vary from these values, which may however still make suitable starting points to find optimal locations by trial and error. Alternatively laser or computational analysis will help identify effective exciter positions.

A cost-effective ways of manufacturing a bending wave panel is by injection moulding. This is not only of moderate unit cost and capable of producing consistent results, but also certain features of attachment of the panel to both exciters and panel support frame, and fixing arrangements may also be included in the mouldings as an integral part of the panel, saving on parts and assembly costs. Injection moulding is effective with panels that are thicker in the middle and taper towards the edge, as forseen.

Quite separately, one of the parameters considered useful to control in a distributed mode speaker is the coincidence frequency, and primarily where it is positioned in the frequency spectrum. The reason for this is that above coincidence the panel operates under a different radiation regime than below it. Coincidence frequency, $f_c$, for some practical bending wave panels often lies somewhere within the audible frequency range and may have audible adverse effects. At the coincidence frequency the sound radiation is more strongly emitted at a wide angle which angle reduces towards the normal axis as frequency is increased. The change of radiation angle, from below the coincidence frequency to above, causes a spatial energy shift, which can be undesirable. Further, aperture effects limit the high frequency performance of less stiff panels. Clamped distributed mode loudspeakers makes possible the use of less stiff panels, but, adding to the mass density may be generally undesirable as it will cause loss in efficiency.

It is considered that it may be desirable to control the coincidence frequency's adverse effect by reducing energy content at one single frequency by spreading over a range of frequencies by varying the bending stiffness over the panel. The net effect is that rather than a sudden transition to a radiation pattern with high energy content, there will be a smooth transition over a wide range of the coincidence.

Due to the change in bending stiffness across the panel, the wavelength of the bending waves in the frequency region around coincidence changes over the panel. For example, in a case where the thickness increases from the centre outwards, the wave velocity increases to the panel edges. Conversely, the wave velocity would reduce when the taper is reversed. This changes the eigenvectors associated with bending waves over the panel surface area.

Figure 2:
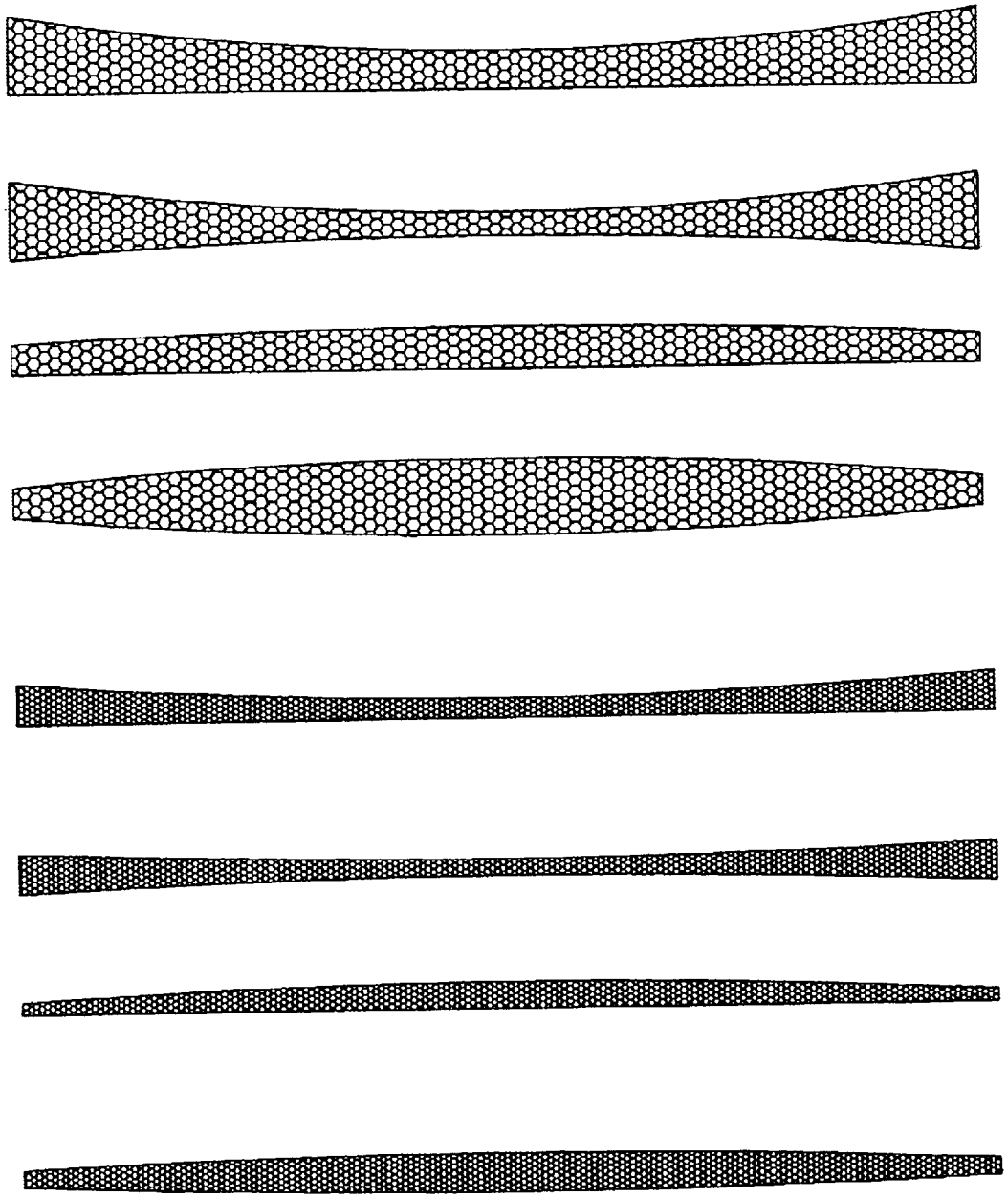
FIG. 2 illustrates panel profiles for use in loudspeakers according to the invention.

The panel stiffness gradient may be changed in a variety of ways. Suitable methods include:

1. Creation of a thickness variation across the panel by a foaming process in injection moulding. FIG. 2 shows some variations of this. It is likely that the added thickness may bring with it some added mass. The additional mass will be small in relation to the added stiffness as the latter changes more rapidly with thickness (approximately with square of thickness in sandwich construction), compared with change in mass which increases fractionally (foam mass density can be very small).
2. In the case where monolithic moulding is used, a stiffness gradient and a surface density gradient may be used (see FIG. 2). In this case, a doubling of thickness will provide an 8-times increase in stiffness, while the surface mass density would only double. Therefore this is still a viable approach for monoliths.
3. Creation of a stiffness gradient may be achieved by compression moulding of a foamed material, e.g. Rohacell or a sandwich panel with skins enclosing foam core, to the required shape. In this case mass density is maintained across the panel surface.
4. Creation of a stiffness gradient may be achieved by using so-called "smart polymers", which have a modulus gradient along their size or area. Variable area or region rigidity polymers are available in sheet form to be used in laminated composites or may be used in injection moulding and other manufacturing processes. Here the panel can retain its uniform thickness, achieving the desired stiffness gradient, without affecting mass.
5. Use of panel contouring, curvature or corrugation. This technique will produce moderate stiffness gradients, unless very small radii of curvature are used. The method may be practical in those applications, for which the "form" required may be combined with styling. see FIGS. 22 & 23.
6. A core may be milled or sanded down to a required profile. Skins may be fixed to either side of the milled or sanded core Injection moulding processes are eminently suitable for making bending wave panels in quantity, at low cost and in a consistent manner. Whilst monolithic radiators can be moulded in a straightforward fashion, they may not be suitable in some applications.

These processes solve the problems of moulding in a "no-added-cost" fashion, as the extra material needed for the foaming is comparatively small. A variation in stiffness by a factor of two gives about 40% spread in the coincidence frequency (e.g. from 10 kHz to 14 kHz) which may be quite helpful and sufficient to spread the coincidence frequency/energy for most applications.

Some possible bending panels with such stiffness variations are shown in FIG. 2. A preferred method suitable for moulding is to create a thickness change outwards with positive or negative gradient. By controlling the foaming agent in the core of the panel a large stiffness gradient may be created across the panel. In a monolithic panel, stiffness changes with the cube power of thickness, while in a sandwich type panel it changes approximately with the square of thickness.

In cases where the stiffness gradient is negative in directions towards the panel edges, one or more of the following advantages may be gained. Firstly, due to the higher stiffness around the middle of the panel, the aperture effect due to the finite size of the exciter coil may be reduced. Secondly, an approximation of an free suspended panel is achieved that may be beneficial in certain applications and has the benefit of a smooth transition to the panel support or frame. Thirdly, injection moulding by gating from the middle of the panel becomes feasible. This produces a low-mass foamed core.

Conversely, when the stiffness gradient is positive in directions towards the panel edges, stiffness may be increased by design to create a smooth transition to a clamped edge panel design. This can give added mechanical robustness of the final construction.

Excitation of the panel may be achieved in any desired manner e.g. as described in our various prior patent applications. Thus, the objective remains to excite the panel modes evenly and with a view to achieving a good degree of smoothness in the mechanical impedance (for input of mechanical power), and/or the acoustic radiated power within the design bandwidth. Such optimised position(s) may be obtained by analysis, e.g. FE methods or empirically.

The behaviour of bending wave panels is well characterised by bending waves at low frequencies, where the panel has a constant bending stiffness and mass density. However, at high frequencies effects such as coincidence and aperture resonance may cause deviations from predictions based on the static calculated values because at these high frequencies the panel may operate with a large degree of shear, which may be characterised by a bending stiffness that falls at higher frequencies. The precise high frequency behaviour can only be determined with a complete knowledge of the shear properties of the panel materials, which is not always available. Therefore, results drawn from the basic equations of constant bending stiffness may not reflect the true behaviour for some panel materials around coincidence. To determine the acoustic properties of panels according to the invention, vibration analysis and experiment may be required.

Acoustic power is the integration of the sound pressure level over all angles. A characteristic which is a smooth function of frequency is often a factor in sound quality. The irregularity in the power output of bending wave panels at coincidence may be spread in frequency by tapering the panel thickness. Increasing the stiffness away from the drive point should spread coincidence to lower frequency; conversely, decreasing the stiffness spreads the range to higher frequencies.

If we consider a large light panel, the increased radiation coupling strength above coincidence means that more of the energy input into the panel is radiated close to the excitation position. Further away from the exciter, the panel velocity is progressively reduced and little power is radiated. Consequently variation in panel thickness should be concentrated relatively close to the exciter or the variation will occur in part of the panel that does not radiate strongly and will have little effect. This has the further advantage that the variation in panel thickness will cause less alteration of performance at lower frequencies: at lower frequencies (below coincidence) the radiation efficiency is much reduced and the energy will be in the form of resonant bending wave modes distributed in frequency and over the whole panel surface.

Alternatively, in a heavy panel, the coupling to radiation is lower and the in addition the sound is radiated over a larger area relative to the panel. The panel variation in stiffness/wave velocity should therefore be concentrated over a larger area.

By the same token the area over which the variation should be apportioned will also depend on the structural material damping, if this is larger than the radiation damping.

In summary the required profile to spread the coincidence effect will depend on panel mass density, bending stiffness, shear properties, and damping properties.

In principle, the variation of bending stiffness of the panel should also widen the directivity. For a panel with a decreasing stiffness from the exciter position the sound radiation will be spread to a larger angle to the normal to the panel. Conversely, for a panel with an increasing stiffness, the sound radiation will be spread to a smaller angle to the normal to the panel. Either way, the range of angles is increased.

In practice, the directivity of the radiation from the panel is much harder to smooth than the acoustic power, as the following discussion illustrates.

Consider the beaming of the radiation above coincidence from part of the panel with velocity, $V_{panel}$. The angle of the beam from the on-axis position is determined by the following equation:

$$\theta = \sin^{-1}\left(\frac{c}{v_{panel}}\right)$$

At a particular frequency the different parts of the panel, with different bending wave velocities, radiate in different directions resulting in a particular polar plot of sound energy as a function of direction.

As the frequency is increased the panel velocity increases and the angle of radiated sound decreases towards the axis position, according to the above formula. The differential of angle with respect to velocity is large for large angles, and decreases as the angle decreases towards the on-axis position. Therefore as the frequency is increased, the sound is emitted in a pattern which changes shape. The energy is focussed into a narrower beam around the normal axis.

The polar plot changes shape with increasing frequency. By specifically varying the bending stiffness over the panel a more uniform sound output can be achieved for a given frequency but the summation of outputs may produce a less smooth output at other frequencies.

Alternatively the sound pressure level at one listening angle can be arranged to remain relatively constant. However, elsewhere the sound pressure may no longer be constant and may show increased beaming effects.

In summary it is not possible to achieve a maximally smooth polar plot for all frequencies or a maximally smooth frequency response for at points. The designer will seek to acheive a useful compromise which delivers a relatively smooth response over a range of points and a relatively smooth polar plot over a range of frequencies.

Experimental Results

The panels tested for FIGS. 4 to 10 consisted of 100 $\mu$m thick glass skins laminated with uncompressed Rohacell.

The tapered panels were formed by laminating the skins onto Rohacell plates that were sanded to the required profile. Relatively large panels were chosen to emphasise the coincidence effect and all had the following dimensions (mididemo size):

panel length: 544 mm
panel width: 480 mm
panel area: 0.26 $m^2$

The drive point chosen was at the centre of the panel in order to simplify the profile of the test panels. The exciter was a 4 ohm NEC electrodynamic exciter with a 13 mm diameter voice coil.

The following measurements were performed on each panel:

1) Sound pressure level as a function of angle around the panel. Measurement distance=1 m. Panel in baffle, total area=1 m. Results presented in units of dB. Data is unsmoothed.
2) Single frequency polar plot to show directivity. Measurement distance=1 m. Panel in baffle total area=1 $m^2$. Results presented in units of dB. Data is third octave smoothed to smooth the fine detailed fluctuations characteristic of a bending panel radiation and thus highlight the coincidence aspects.
3) Acoustic power. Measurement distance=1 m. Panel in baffle total area=1 $m^2$. Results presented in units of dB. Data is unsmoothed.
4) Drive point velocity measured with the laser velocity system. Results presented in units of mm/s/V. Data is unsmoothed.
5) Scans of the distribution of panel velocity over its area. There are used to determine the wavelength in the panel at a given frequency of excitation and hence the bending wave velocity.

First, the results from comparitive panels with constant bending stiffness will be presented.

FIG. 3*a* shows the bending wave velocity calculated from the material parameters of the panel, for three different uniform thicknesses of panel: 4 mm, 3 mm and 2 mm respectively.

FIG. 3*b* shows the experimental determination of the panel velocity for these panels, found from the image of the vibration pattern in the panel at fixed frequencies. At low frequencies the predicted values agree with the experimental results. However, at high frequencies the measured velocity is less than the predicted value due to the influence of shear. The velocity varies more slowly with frequency than the square root dependence expected for pure bending at high frequencies.

Figure 3:
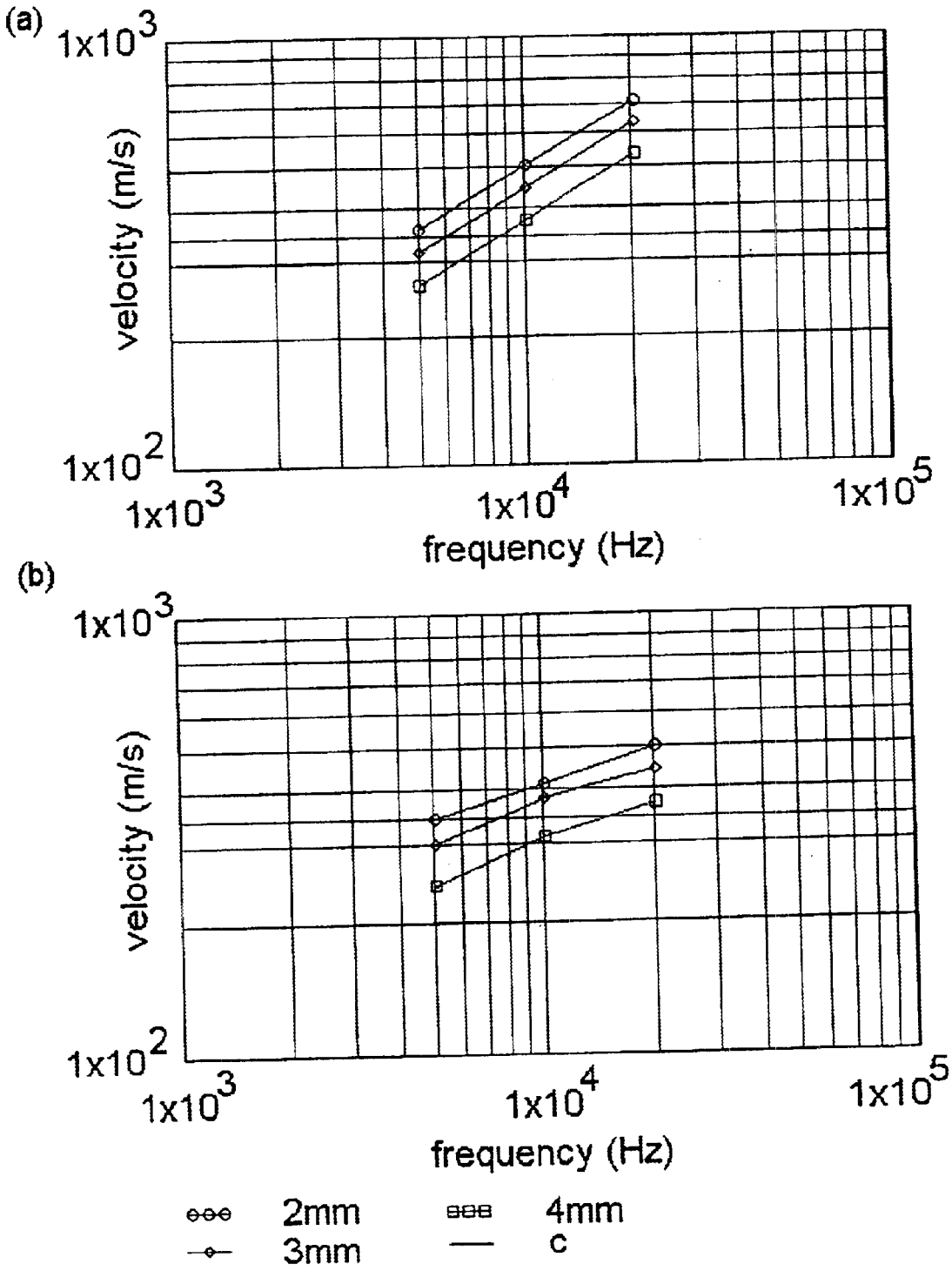
FIGS. 3 to 6 show sound velocity and sound output from a uniform thickness loudspeaker, presented for comparison purposes.

Also shown on the graphs in FIG. 3 is a line labelled "c" representing the speed of sound in air. The frequencies at which this line crosses the velocity trace for each panel thickness is the coincidence frequency. The prediction/calculation from the static or low frequency bending stiffness suggests an increase in the coincidence frequency from approximately 5 kHz to 8.5 kHz when the panel thickness is reduced from 4 mm to 2 mm. In practice this change in thickness results in a much greater variation in coincidence frequency from 5 kHz to 14 kHz. The 4 mm panel had a 5 kHz coincidence frequency, the 3 mm a 7 kHz coincidence frequency and the 2 mm panel a 14 kHz coincidence frequency.

The tapered panels described later have a thickness of 4 mm at the drive point, reducing to 2 mm at the edge.

Figure 4:
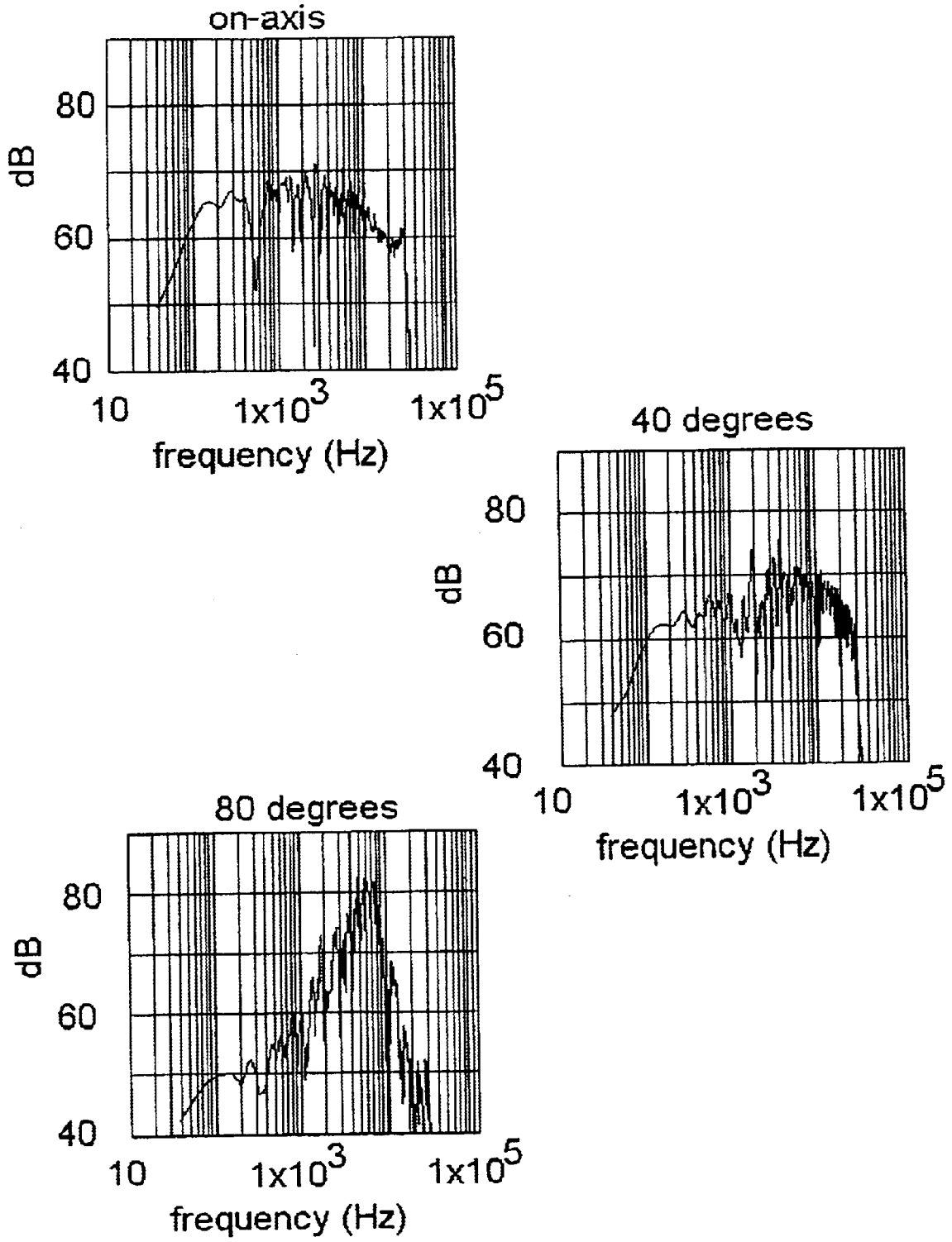
Figure 5:
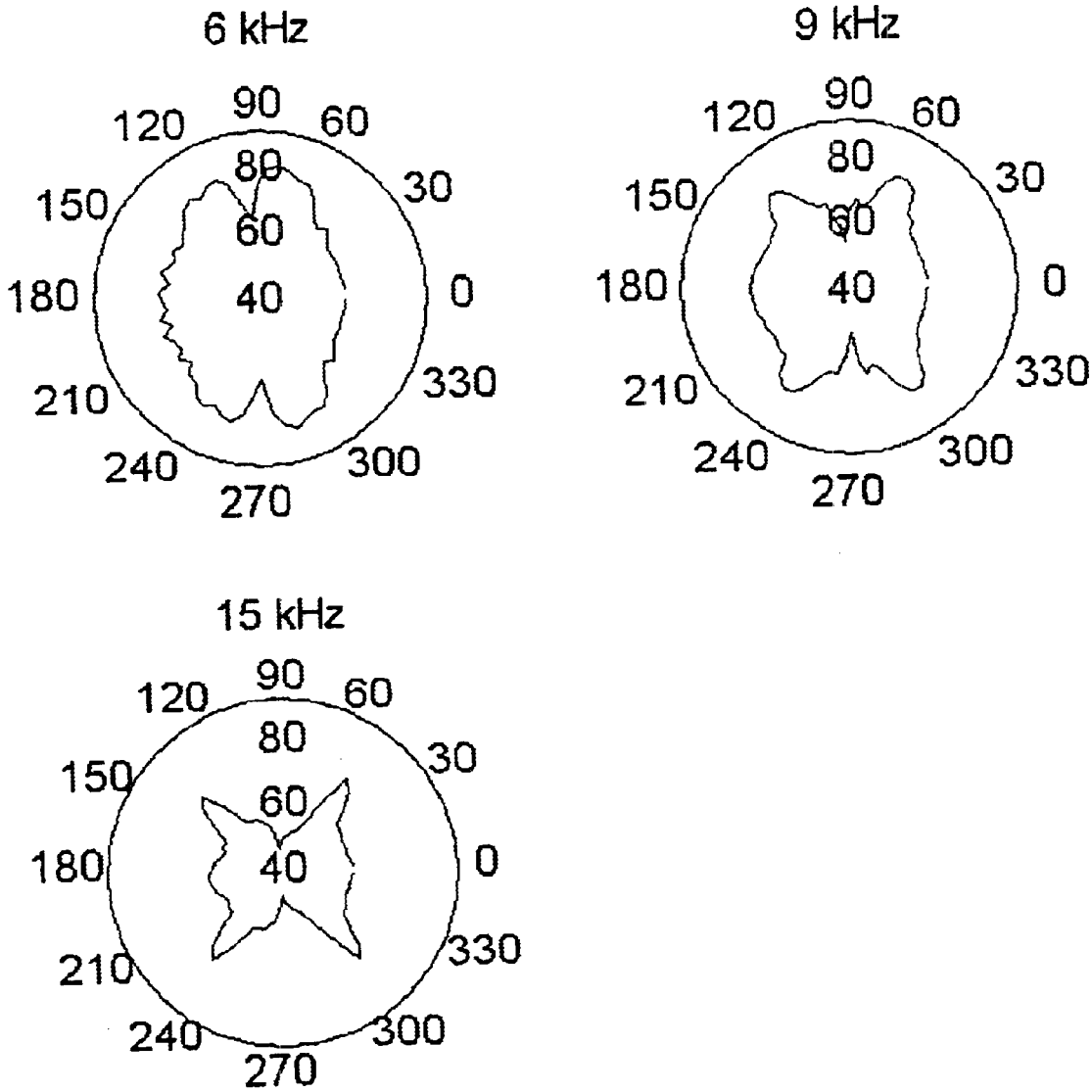
Figure 6:
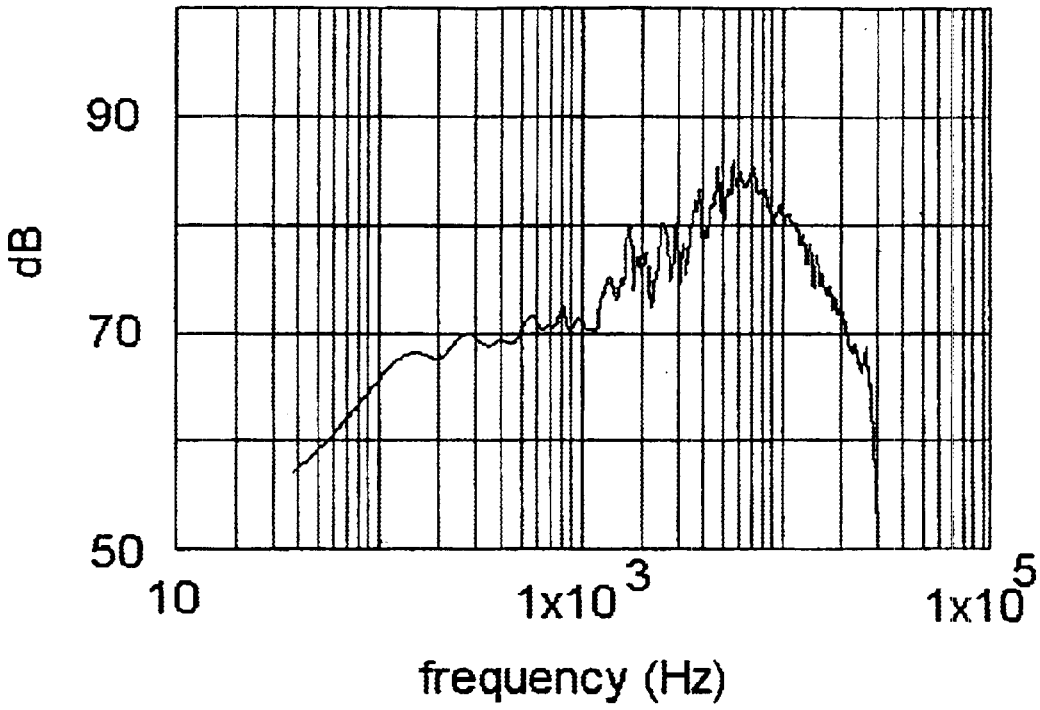
Figure 7:
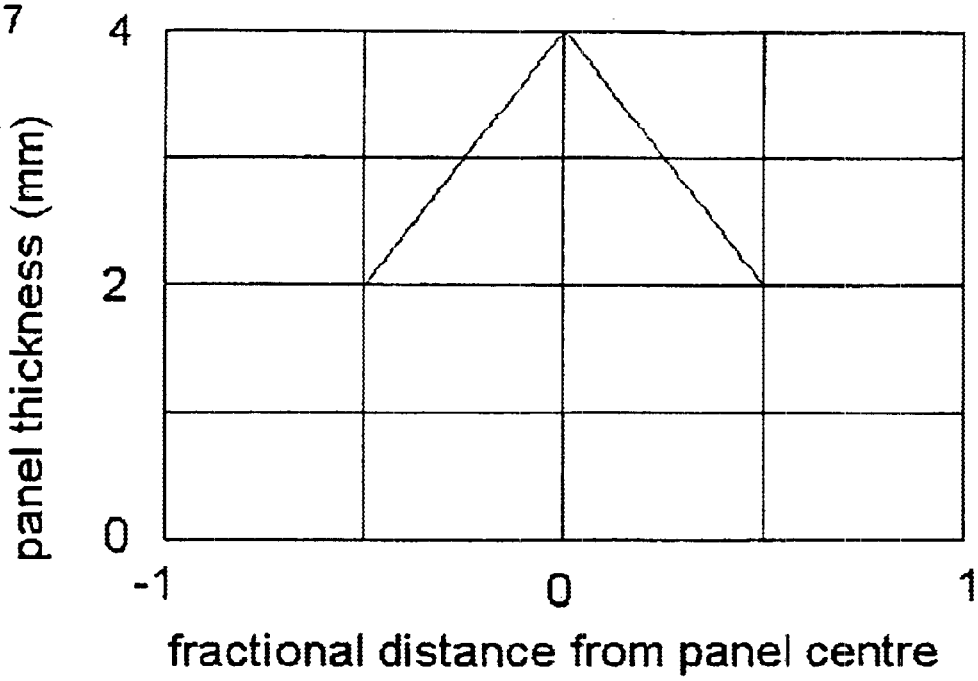
FIG. 7 shows parameters of a loudspeaker according to the first embodiment of the invention.
Figure 7:
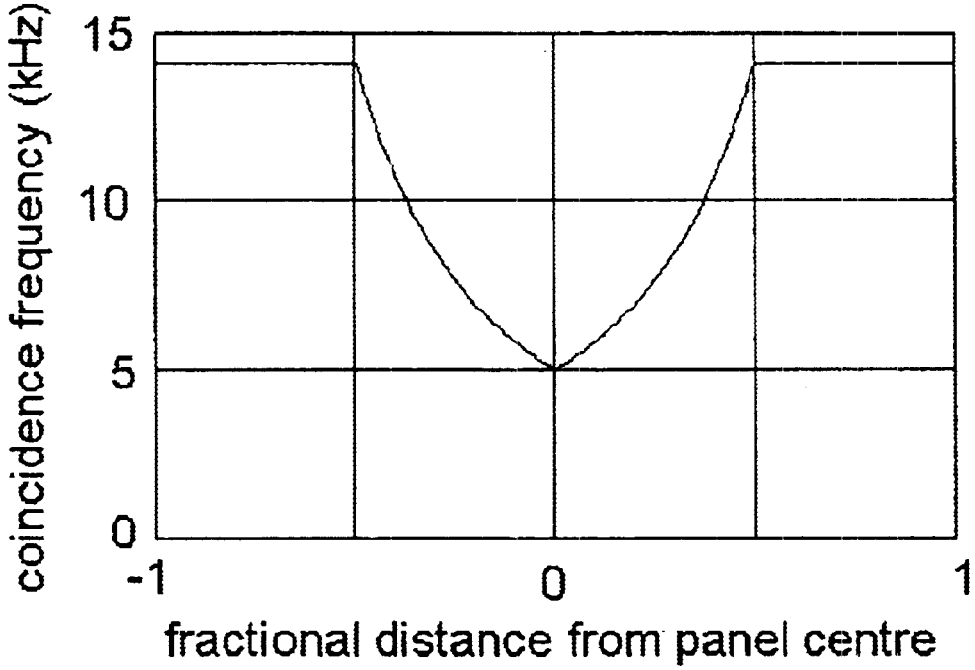

The coincidence effects that the invention addresses are illustrated in FIGS. 4–6 which show measurements on a 4 mm thick flat panel.

FIG. 4 shows measurements of the single point frequency response on axis and at 40° and 80° off axis. As the angle is increased away from the on-axis position the low frequencies are attenuated due to some acoustic cancellation. At 80° a high frequency peak occurs at close to 5 kHz, the coincidence frequency of this panel. The peak sound output at 80° reaches 80 dB which is approximately 14 dB greater than the on-axis response at this frequency. This peak in the response followed by a degree of attenuation is characteristic of the coincidence effect in a large stiff panel.

FIG. 5 shows the polar plots of the sound pressure level in different directions at 6 kHz, 9 kHz and 15 kHz. The narrowing of the radiation is clear, starting at 90° for 6 kHz decreasing to less than 60° at 15 kHz. This beaming to radiate at an angle that decreases with increasing frequency is characteristic of the coincidence effect.

FIG. 6 shows the acoustic power as a function of frequency. At low frequencies the power is slowly varying. However as the frequency is further increased the power rises to a maximum close to the coincidence frequency then falls back at higher frequency. The maxiumum is much broader than that seen in the sound pressure level traces in FIG. 5. This is because the power measurement is an integration of the sound pressure level over all angles and therefore does not reflect the changing directivity, only the total acoustic output which varies relatively slowly with frequency. This maximum in the power response is also characteristic of the coincidence effect as seen in large stiff bending radiators.

A first embodiment of a loudspeaker according to the invention will now be described. The loudspeaker has, a tapered panel.

FIG. 7*a* shows the profile of the tapered panel as a function of the fractional distance to the edge of the panel. The panel was milled to this profile in both the x and y planes, forming a pyramid shape in the central region. Also shown in FIG. 7*b* is the corresponding graph of the coincidence frequency, which shows that the greater variation is located relatively close to the exciter position.

Figure 8:
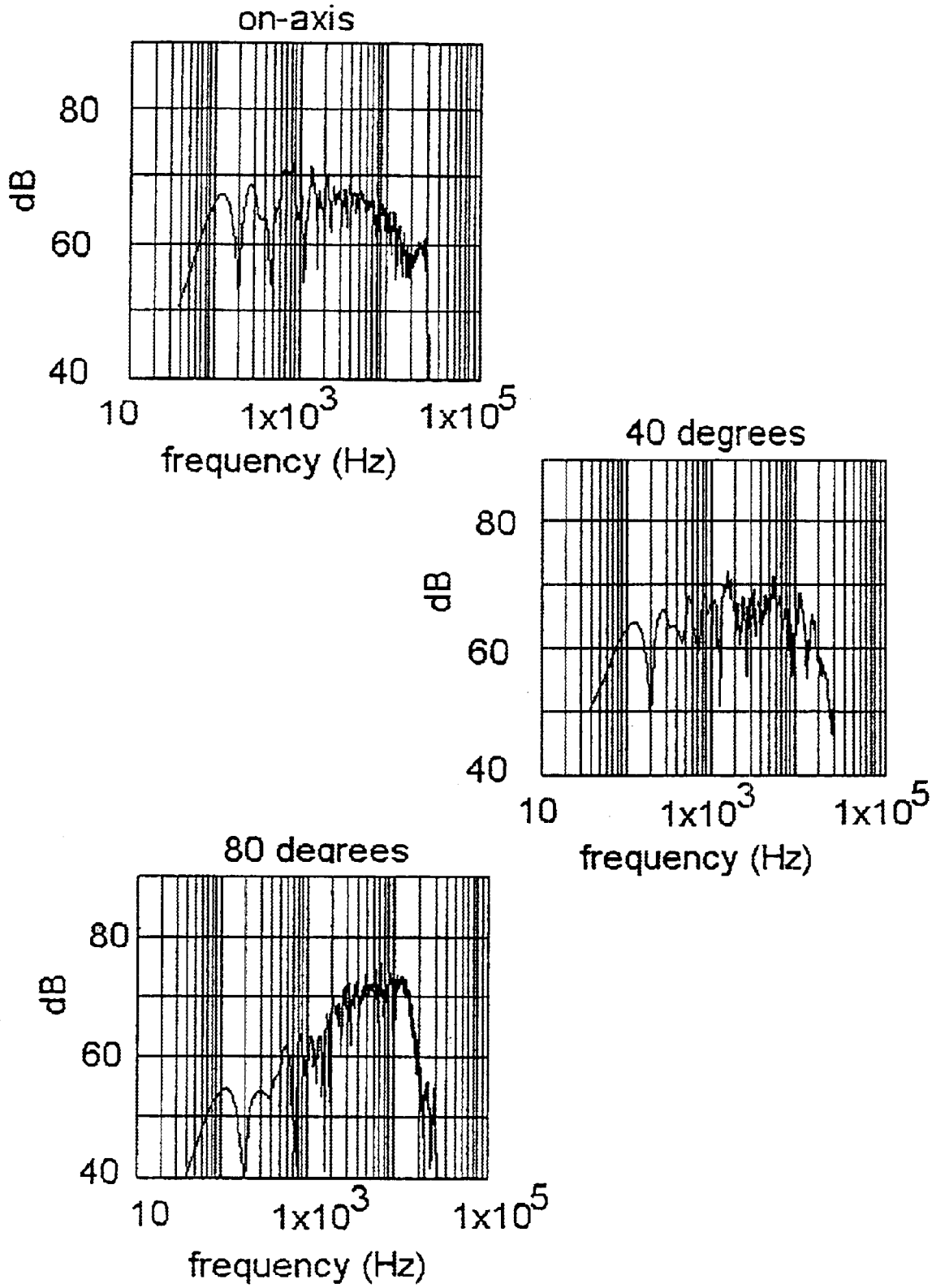
FIGS. 8 to 10 are results obtained using the loudspeaker illustrated in FIG. 7.

FIG. 8 shows the single point frequency responses for increasing angle around the panel. The on-axis response is similar to the reference panel in both high and low frequency extension.

The coincidence maximum shown by the flat panel is attentuated by up to 10 db in this embodiment. The width of the maximum is also increased, by a factor of approximately 2.

Above coincidence the large attenuation of the sound pressure level at 80° relative to the on-axis response observed in the comparative example is not present in the panel according to the embodiment, significantly improving the high frequency off-axis response.

Figure 9:
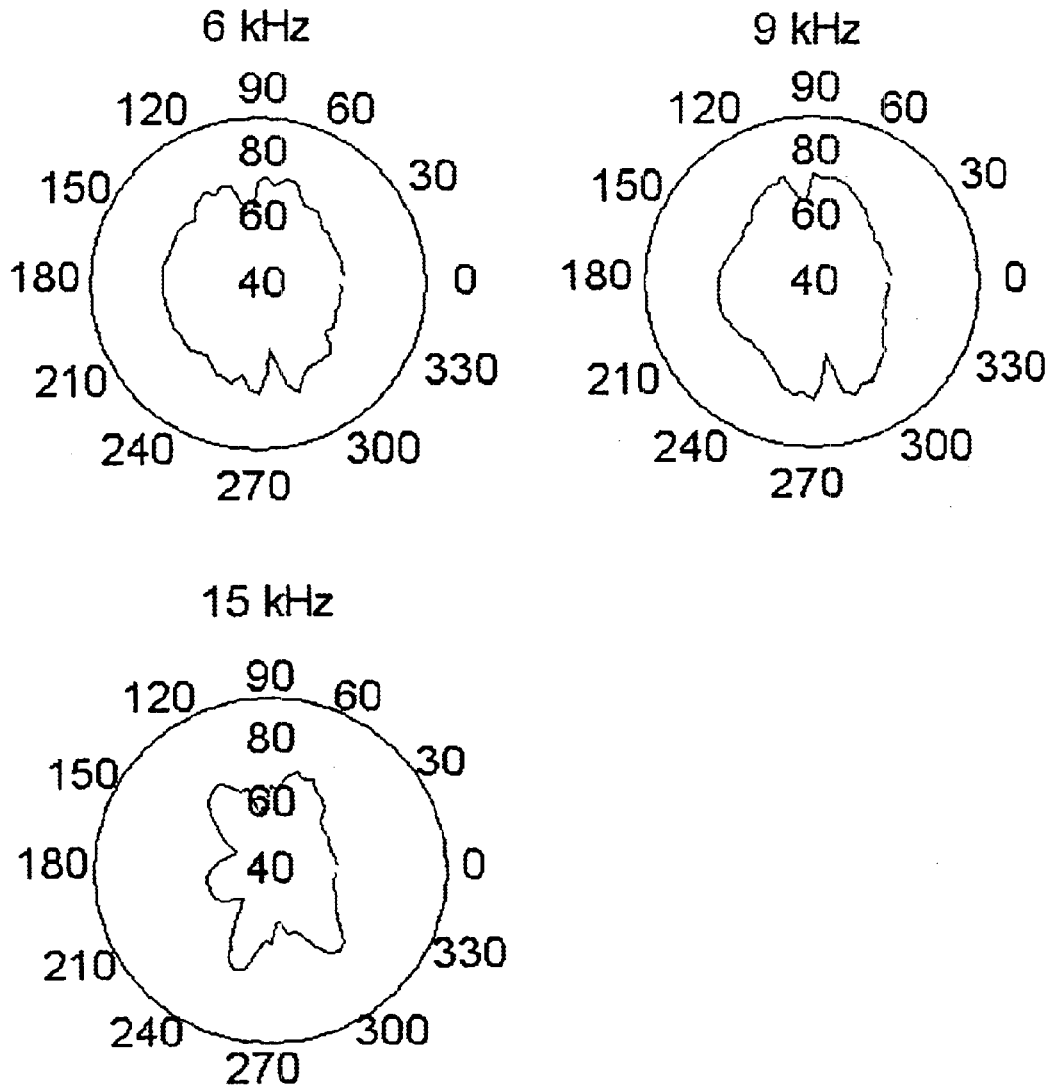

FIG. 9 shows the polar plots of the sound pressure level at the same frequencies of 6 kHz, 9 kHz and 15 kHz shown in FIG. 5. It is clear from a comparison of these two figures that the polar plot of the panel according to the first embodiment shows significantly less beaming than the reference flat panel.

Figure 10:
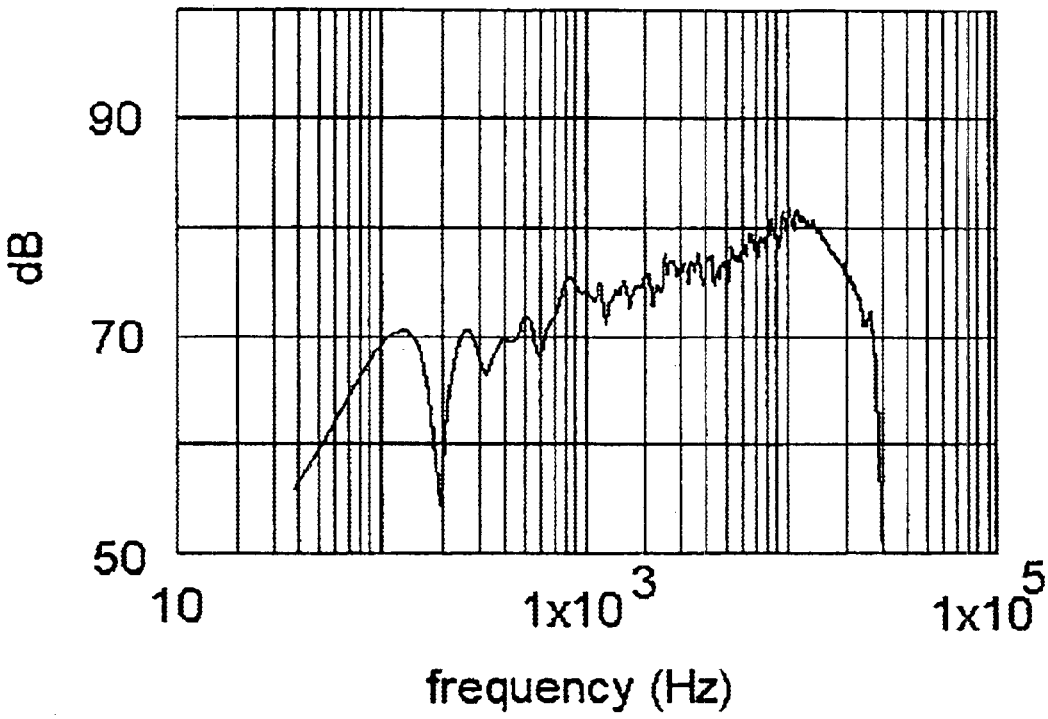
Figure 11:
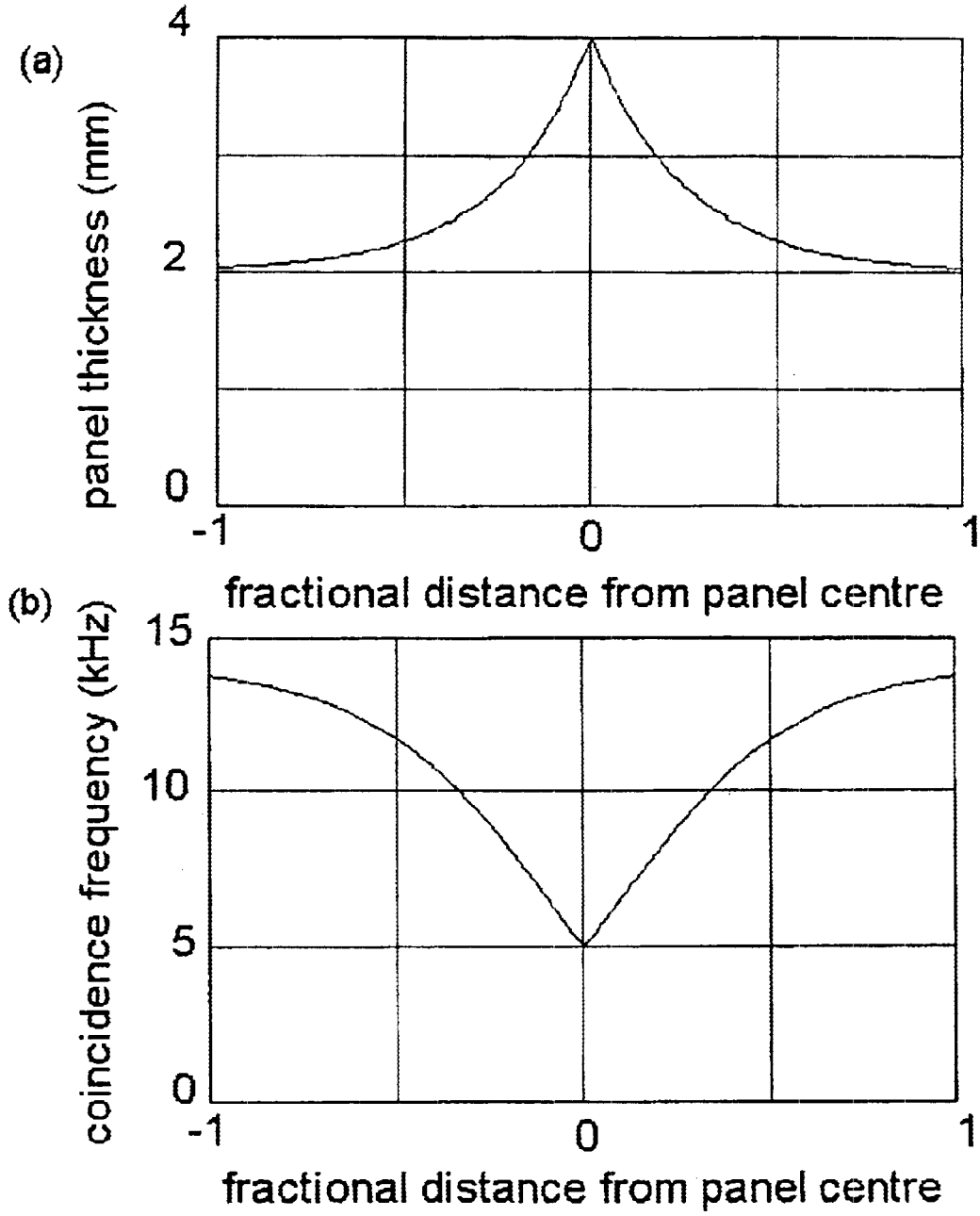
FIG. 11 shows parameters of a second embodiment of the invention.
Figure 12:
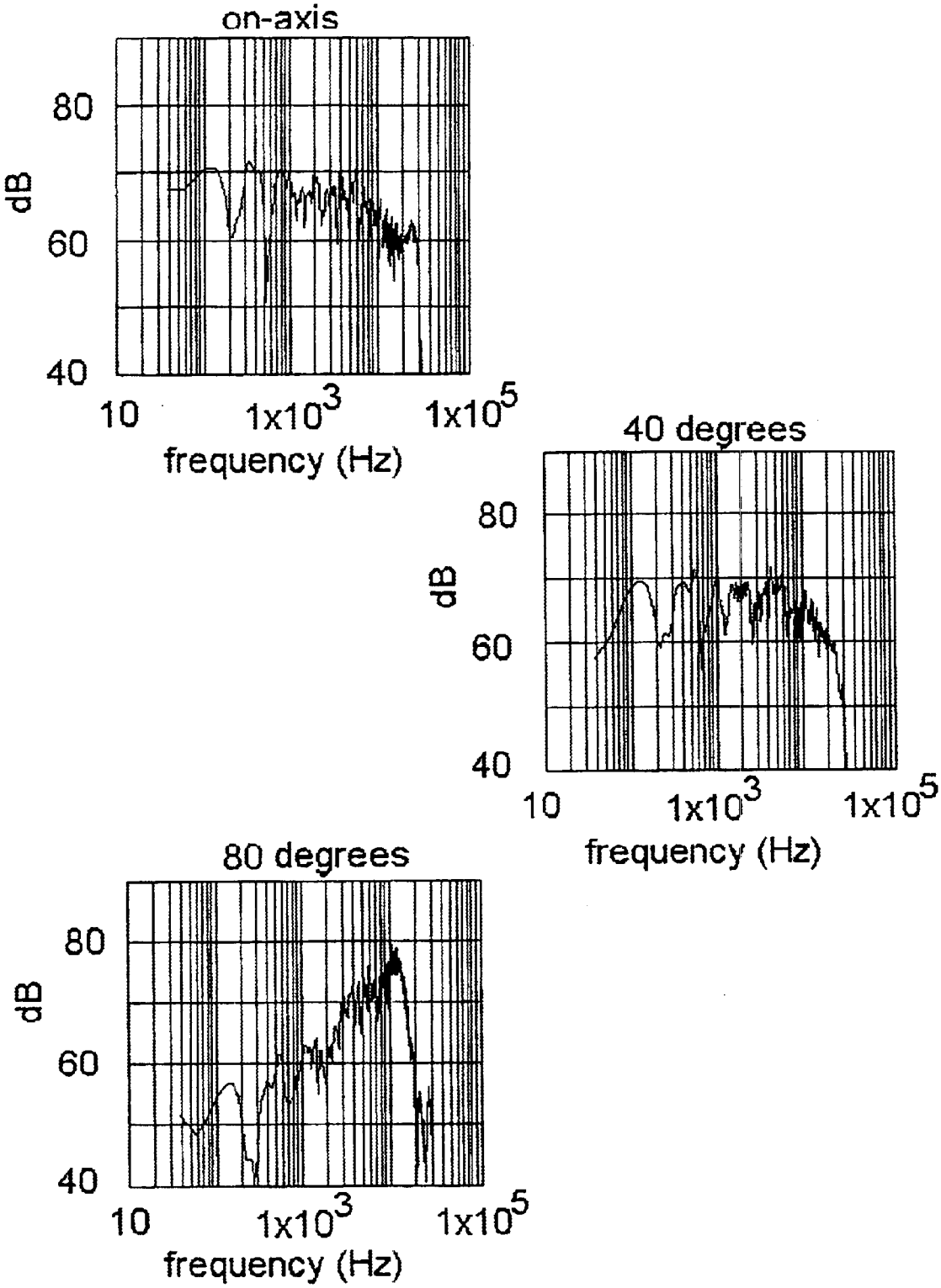
FIGS. 12 to 14 are results obtained using the loudspeaker illustrated in FIG. 11.
Figure 13:
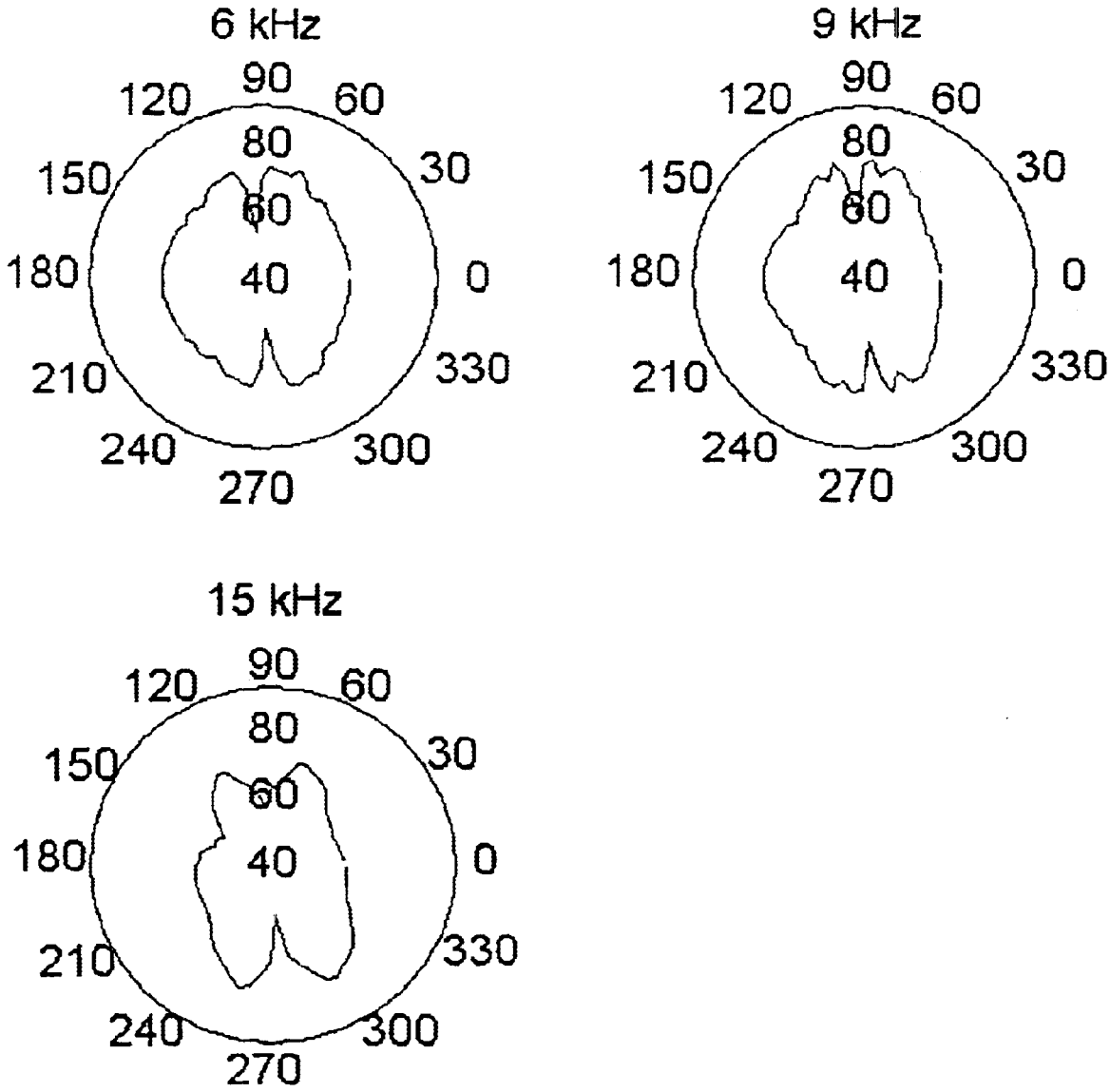
Figure 14:
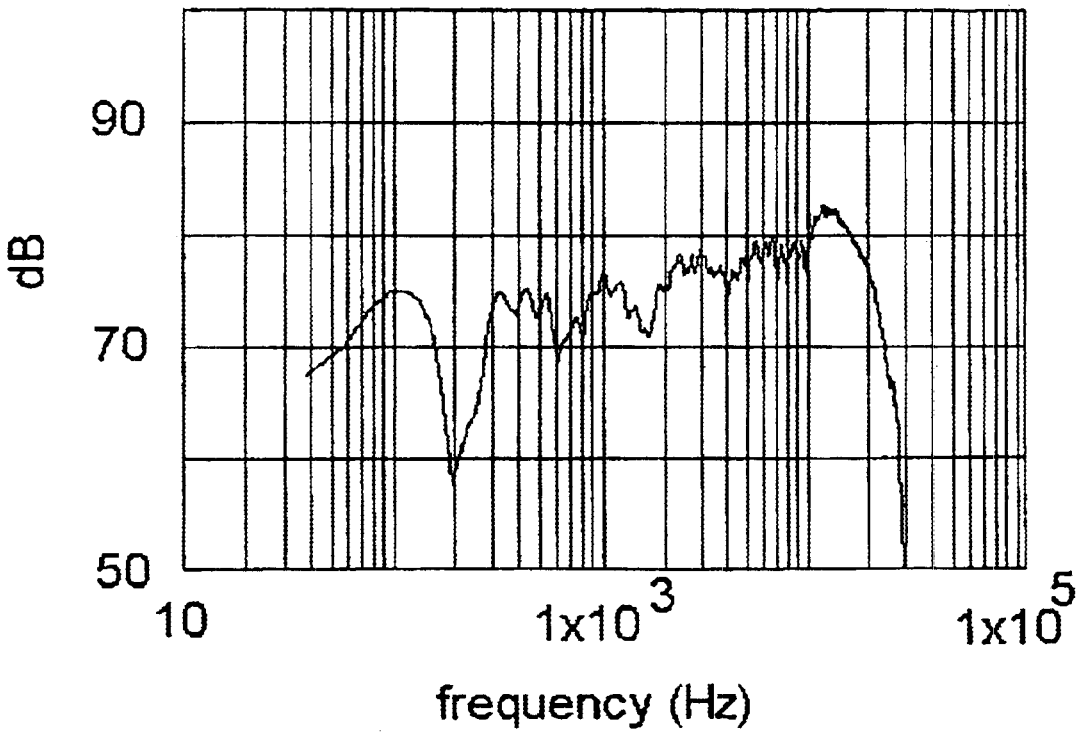

FIG. 10 shows the acoustic power radiated by the panel according to the first embodiment. When this is compared to the reference panel response shown in FIG. 6 it is evident that the coincidence maximum is attenuated by 5 dB and is broadened to higher frequency, as predicted for a tapered panel with a decreasing stiffness towards the edge.

In summary, the tested panel shows a significant improvement over the flat panel in all aspects of the problems due to coincidence. As such it represents a good compromise of the panel profile with significant improvements in each aspect of the problems of coincidence whilst retaining a good frequency response.

The results for a loudspeaker according to a second embodiment of the invention with a large variation in gradient over the panel area are shown in FIGS. 11 to 14. These results are very similar to the results for the panel of FIG. 7.

Both panels represent a good compromise that improves all aspects of the coincidence radiation characteristics. The second panel shows a slightly degraded set of single point frequency responses and acoustic power traces relative to the first, whereas the single frequency polar plot results are slightly improved. While the optimisation will always be a compromise, the designer may choose according to the requirements of the application.

The first two embodiments relate to a panel of moderate size. A third embodiment will now be discussed of small size, (A5–210 by 148.5 mm)

Figure 15:
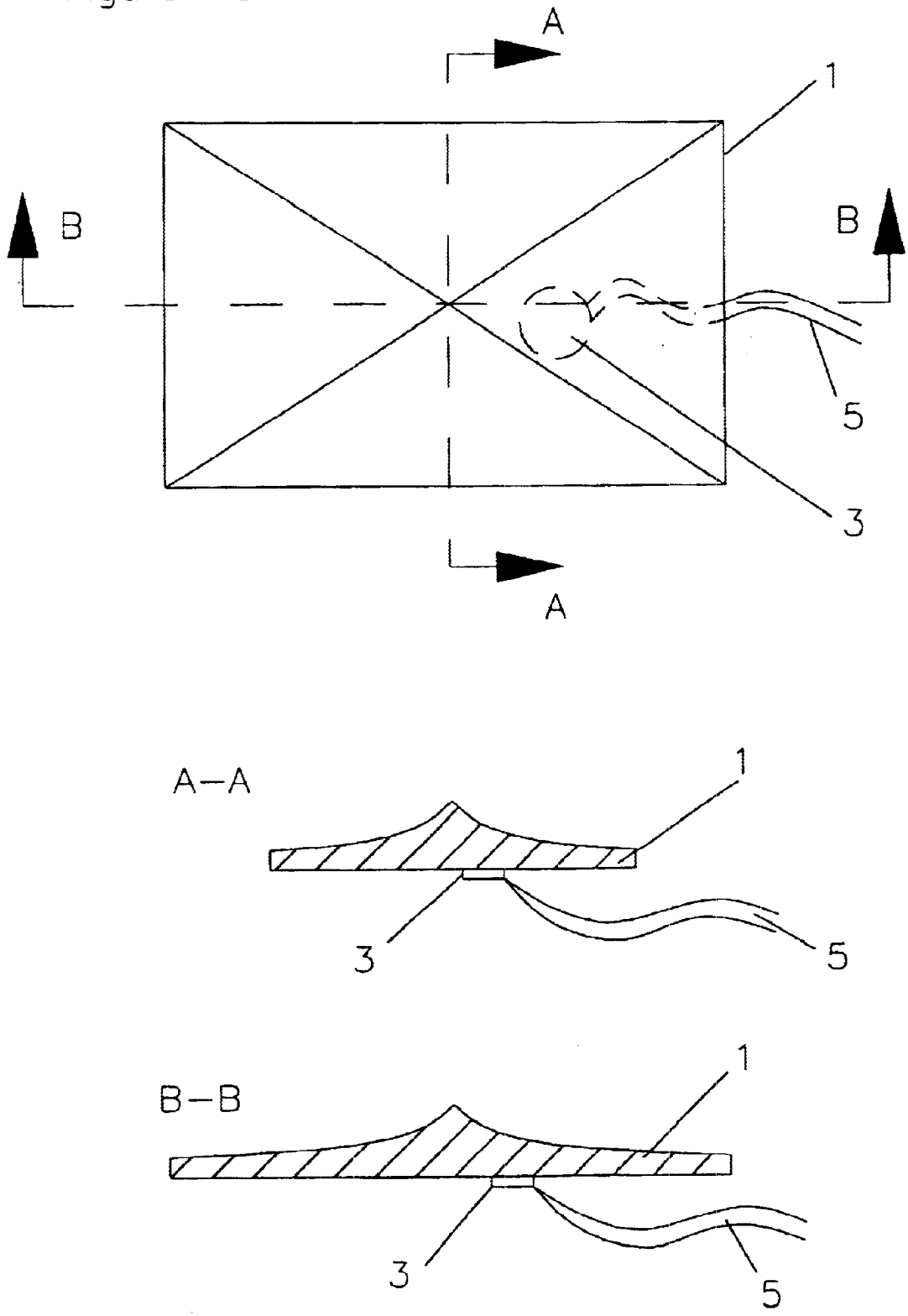
FIG. 15 illustrates a third embodiment of the invention.
Figure 16:
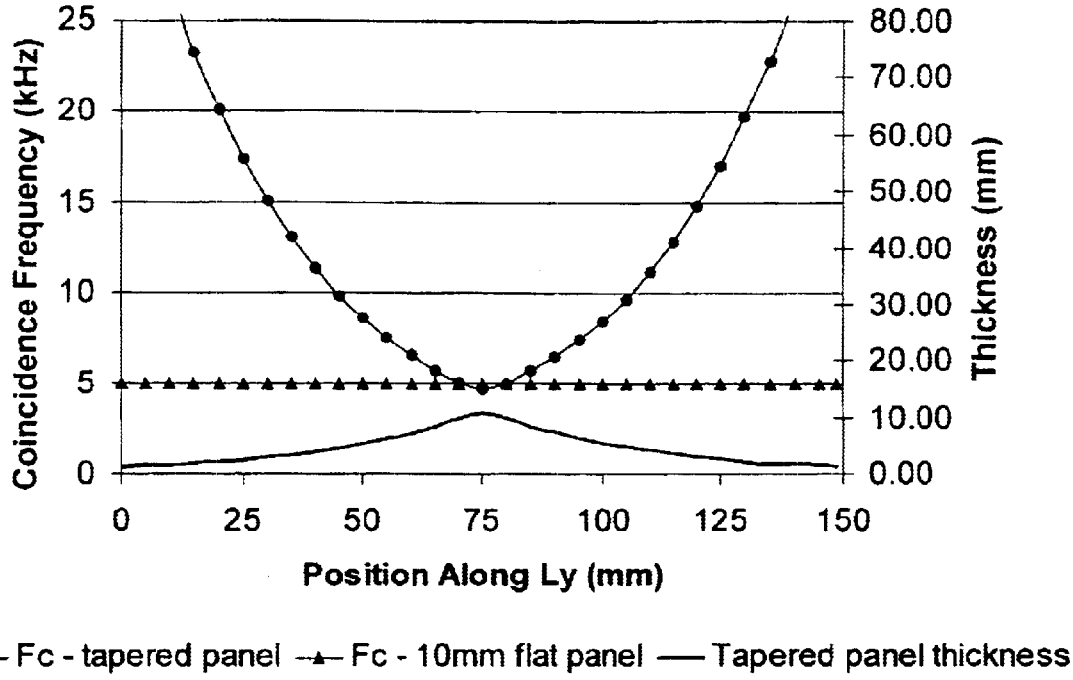
FIG. 16 illustrates the coincidence frequency variation over the panel of FIG. 15.

FIGS. 15 and 16 show the panel profile. As can be seen, it is very highly tapered. The panel is made from 14.5 mm thick Rohacell compressed to 10.8 mm at the centre and 1 mm at the edge. The control flat panel is compressed to 9.8 mm over its whole surface. The exciter is mounted on the rear of the panel at a position that is optimal for a isotropic panel. Good results are obtained with this exciter position even for the tapered panel, though a further optimisation of exciter position would be envisaged.

FIG. 16 shows a plot of coincidence frequency calculated as a function of position over the panel.

Figure 17:
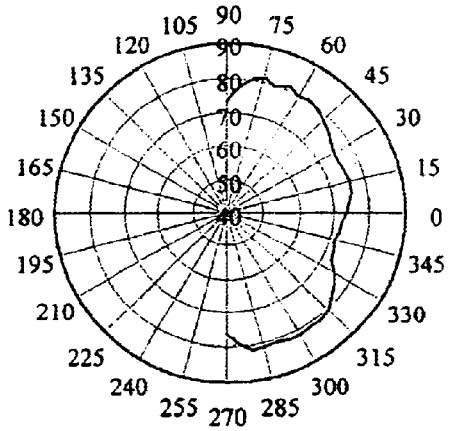
FIGS. 17 and 18 are results obtained using the loudspeaker of FIG. 15.
Figure 17:
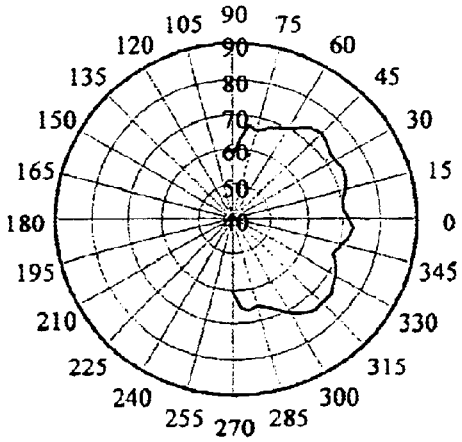
Figure 17:
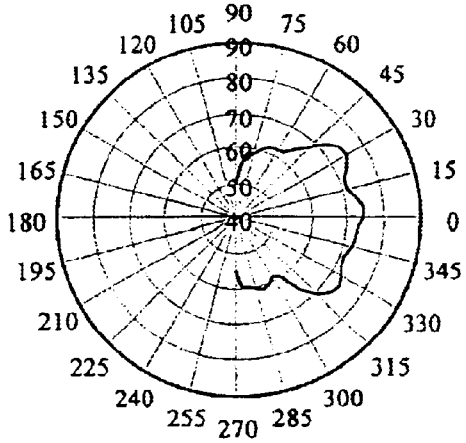
Figure 17:
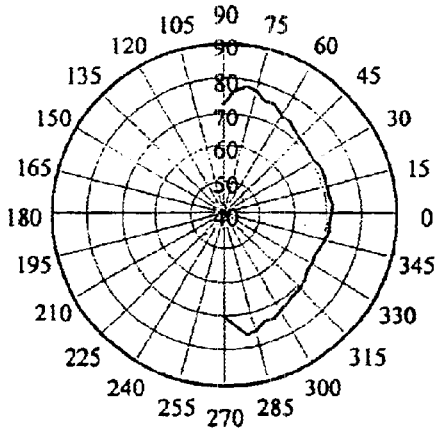
Figure 17:
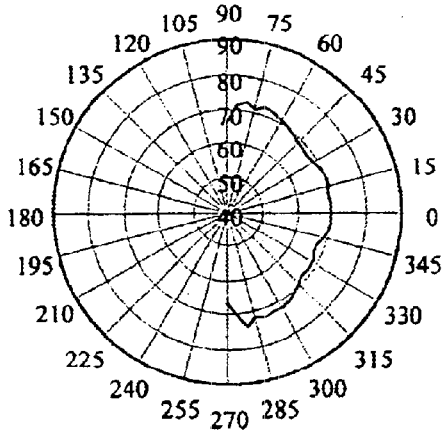
Figure 17:
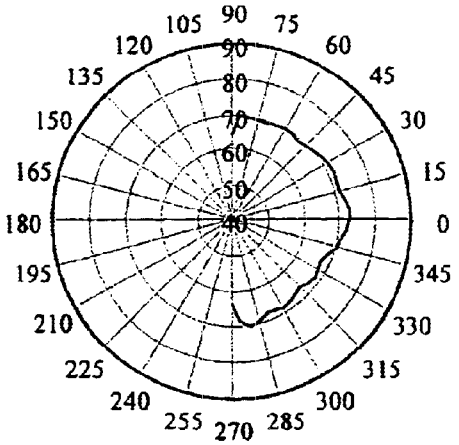
Figure 18:
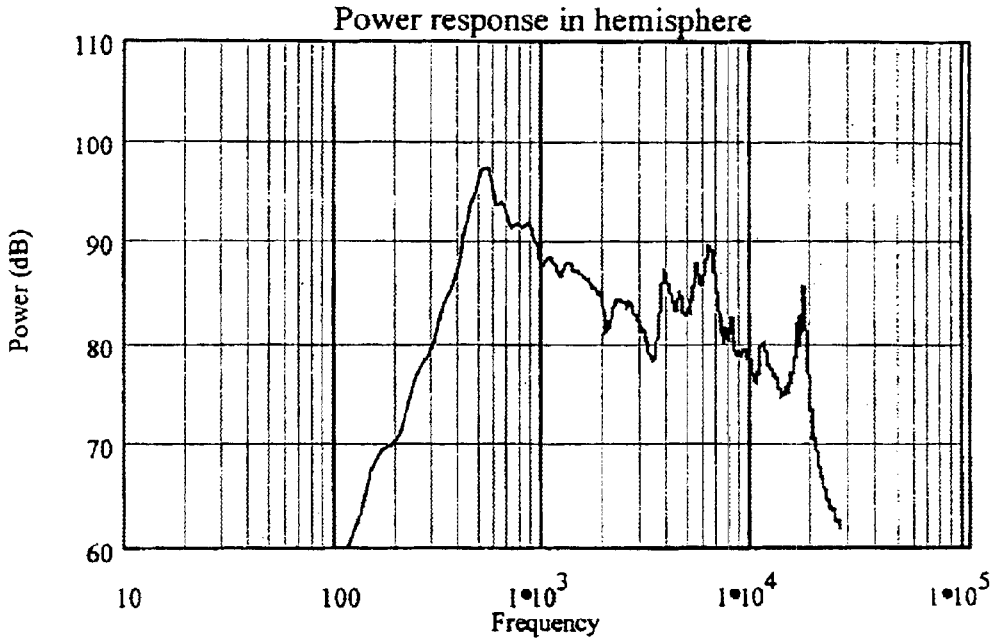
Figure 18:
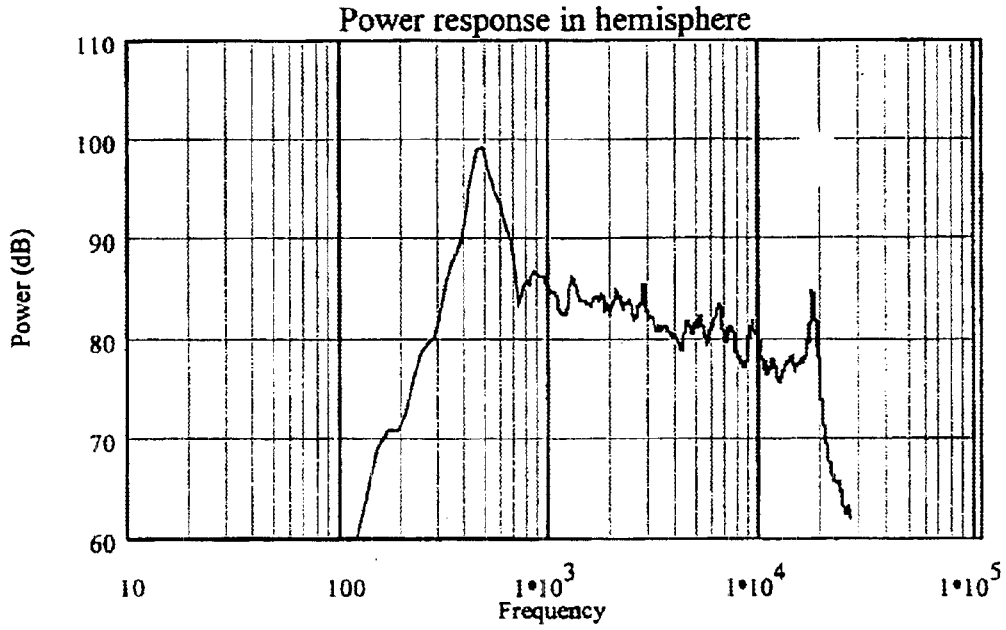

Comparative results of a 10 mm flat panel of the same size and the tapered panel are shown in FIG. 17. Acoustic power measurements are shown in FIG. 18*a* (flat panel) is and FIG. 18*b* (tapered panel).

As can be seen, the panel demonstrates excellent wide directivity: even at 13 kHz sound is radiated evenly into the front hemisphere. The power response of the tapered panel also does not show a significant step around 5 kHz; such a step is clearly visible in the reference panel response. It should be noted that these test panels are mounted on a shallow box, which gives rise to the maximum around 500 Hz. This would need to be controlled in a practical loudspeaker, by an electrical filter or otherwise. It is caused by the box, not the taper.

A number of tests on further panels have been carried out. The results demonstrate the improvement in the various effects caused by coincidence in panels according to the invention. In order to smooth the directivity effects the profile is important, whereas the exact profile is much less important to achieve smoothing of the total acoustic power.

Figure 19:
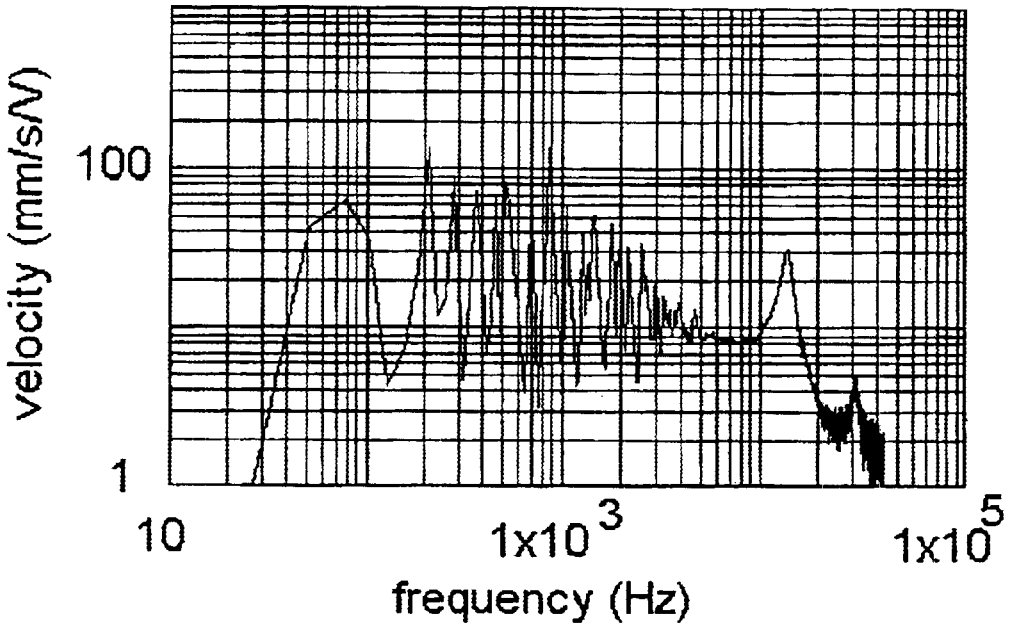
FIGS. 19 to 21 illustrate the effects of aperture resonance in the panel shown in FIG. 9.
Figure 20:
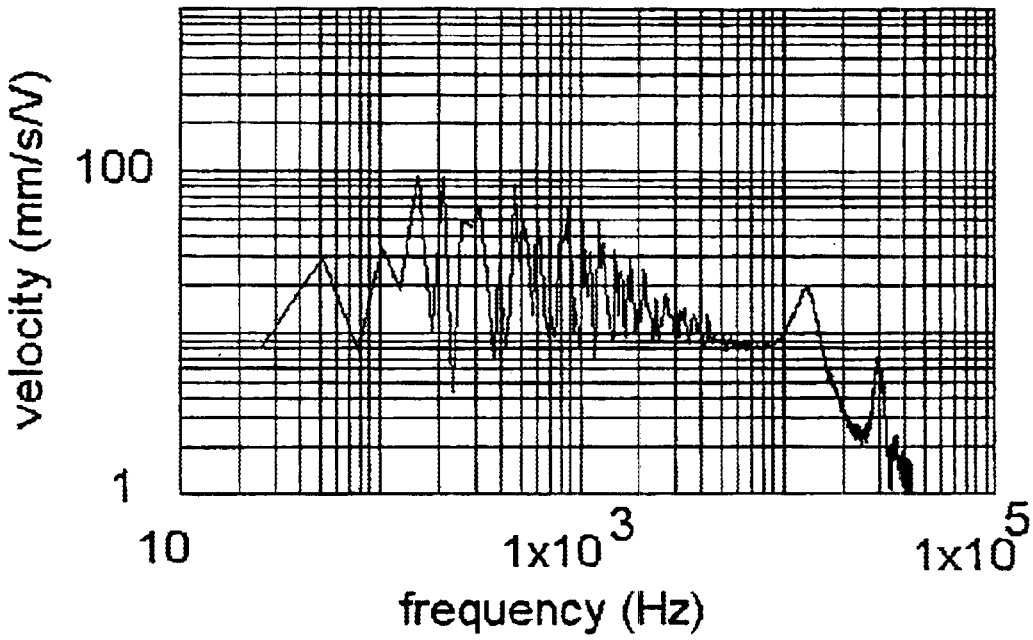
Figure 21:
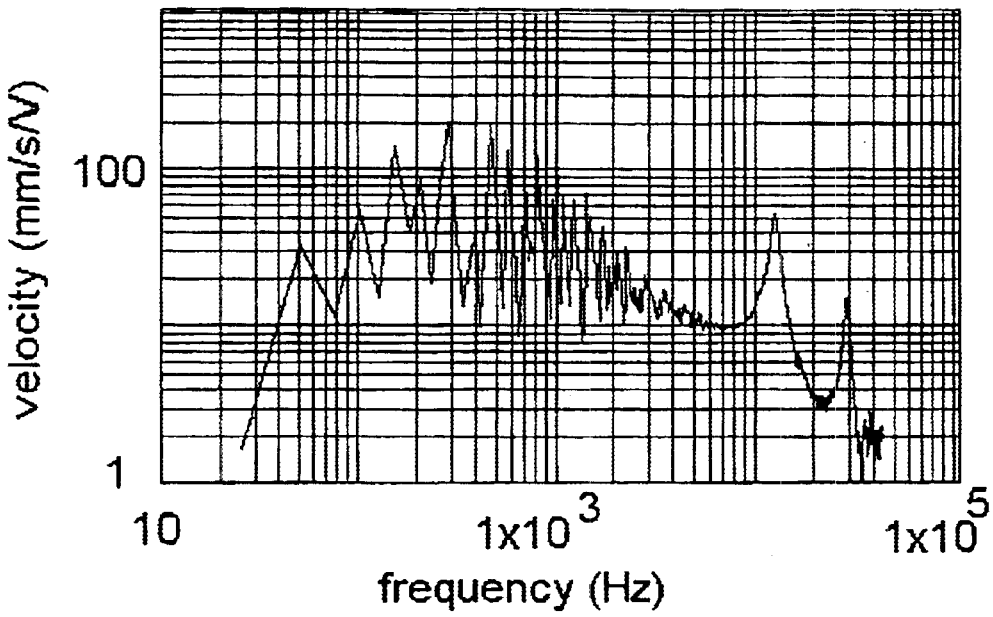

FIGS. 19 to 21 show measurements of the drive point velocity of three panels, excited by a transducer with a voice coil diameter of 25 mm. FIG. 19 shows the results of a 4 mm flat panel, FIG. 20 the results from the panel of the first embodiment, and FIG. 21 the results from a 2 mm flat panel.

Aperture resonance is evident in the velocity traces as a sharp peak between 10 kHz and 20 kHz. For the 4mm and the tapered panel, the resonance occurs at 13.1 kHz. For the 2 mm panel, the resonance occurs at 11.8 kHz.

As expected, the resonance frequency for the flat panels increases with increasing panel stiffness. The resonance frequency for the tapered panel is determined by the panel thickness at the drive point, and is therefore similar to the 4 mm thick flat panel.

This shows that the aperture resonance is determined by the thickness at the drive point. Accordingly, having a stiff panel section at the exciter location minimises this aperture resonance.

Results (not shown) also indicate that when the variation in bending stiffness is concentrated around the edge of the panel, the effect on radiation characteristics above the coincidence frequency is small. However, such a treatment of a panel can have beneficial effects, as will now be described.

In order to make a practical speaker the panel is often mounted in some frame/support. The aim here is to keep the vibrational energy in the panel, with minimum transmission to the frame. This is achieved with a large impedance mismatch between the panel and frame. Varying the panel thickness at the edge allows the impedance at the panel/frame boundary to be controlled without significantly affecting the overall radiation characteristics. A few examples where such an approach might be beneficial will now be presented.

Tapering a panel down to a very small thickness close to an edge reduces the panel impedance to a very small value. If this impedance is well below that of a clamping frame then very little energy is transferred.

Increasing the panel thickness at an edge will increase the impedance significantly. If the panel is connected to a frame with a soft termination (and a correspondingly low impedance) then the increase in panel impedance creates a larger mismatch at the boundary and minimises the energy transfer to the frame.

In addition to the above two examples, a sharp increase/decrease in panel thickness at the boundary should reflect energy back into the body of the panel. For example, sharply increasing the panel thickness at the edge provides an approximation to a clamped boundary and the energy incident on the boundary is reflected back into the panel. The edge can then be safely clamped or supported as it contains very little vibrational energy.

Figure 22:
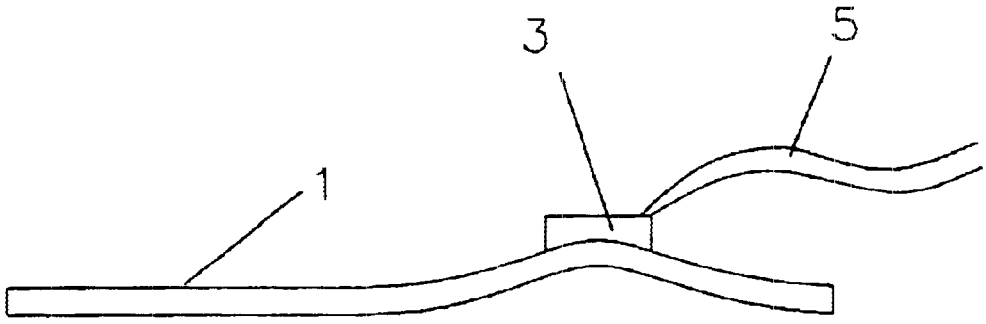
FIGS. 22 and 23 illustrate alternative methods of achieving bending stiffness variation.
Figure 23:
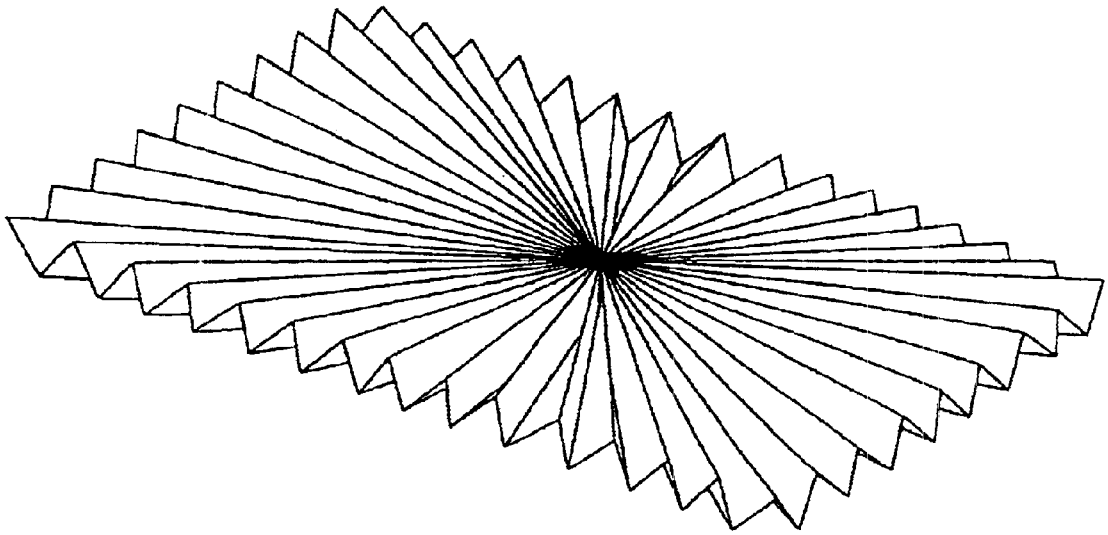

It is not necessary to vary the thickness of a panel to achieve bending stiffness variation. FIG. 22 shows a panel which is of constant thickness but in which the radius of curvature varies over the panel area. This causes a variation in bending stiffness. An alternative approach is illustrated in FIG. 23. A panel is corrugated as shown, to achieve a higher bending stiffness in the central region than in the outer region.

Figure 24:
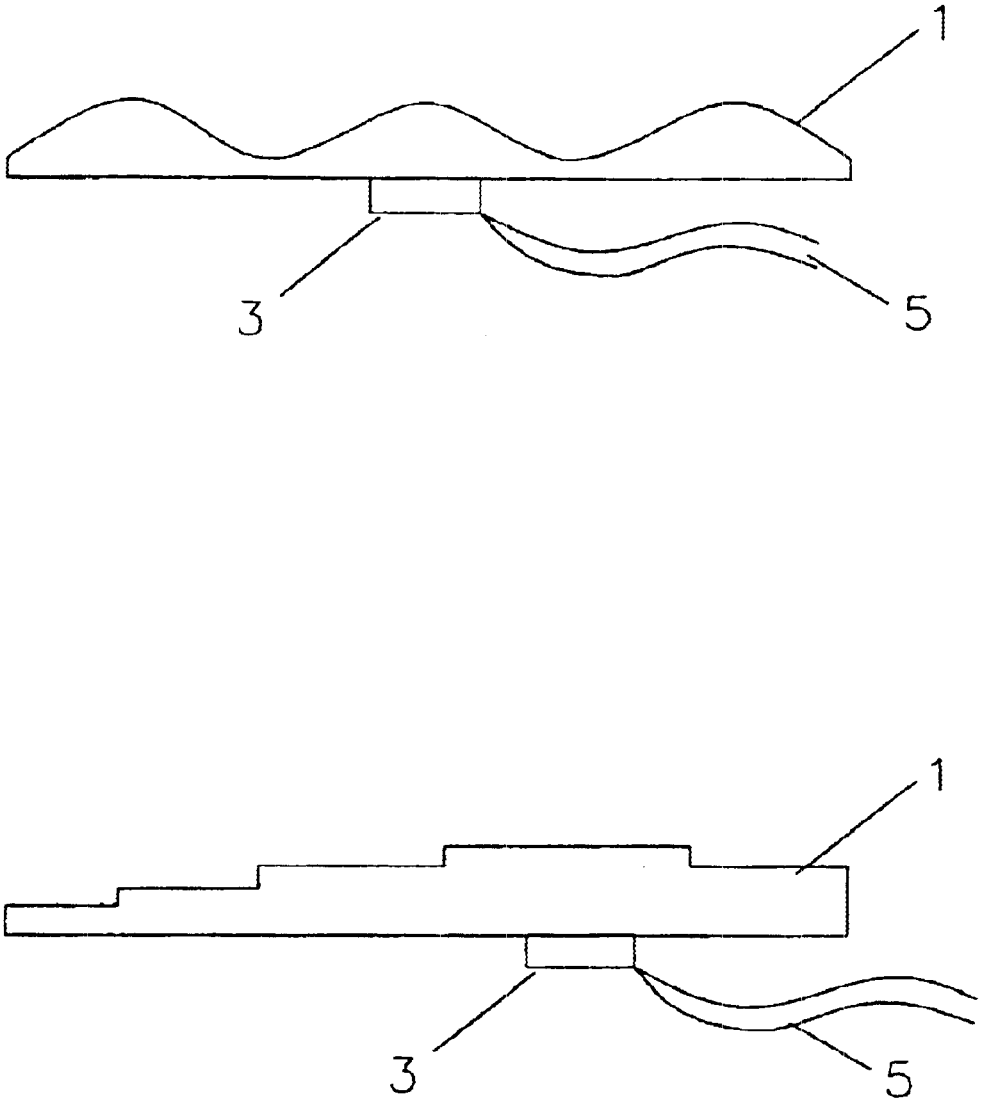
FIG. 24 shows alternative panel profiles.

The thickness of the panel also does not need to vary in the simple ways shown above. For example, the bending stiffness can vary over the surface in an undulating pattern, or in a series of steps over the surface of the panel. A few possible profiles are shown in FIG. 24. Such profiles can be achieved by corresponding undulations and steps in the thickness of the panel, or otherwise.

What is claimed is:

1. A loudspeaker comprising a panel form acoustic member capable of supporting bending wave vibration and an exciter fixed to the member to excite bending waves in the member to cause an acoustic output, wherein the bending wave velocity in the member is specifically varied in the region of coincidence to produce a range of coincidence frequencies so that acoustic coupling of the bending waves in the member to the sound waves in ambient air occurs over a broader range of angles and/or so that the acoustical power coupling to the ambient air is more uniform, and wherein the member is a panel with a bending stiffness that varies with position over the area of the panel, so that the effect of coincidence on the acoustic output of the panel is smoothed.

2. A loudspeaker according to claim 1 wherein the bending stiffness of the panel varies over an area of at least 10% of the panel area.

3. A loudspeaker according to claim 1 or 2 wherein the bending stiffness has a maximum value and the exciter is coupled to the panel at a position having a bending stiffness at least 70% of the maximum value.

4. A loudspeaker according to claim 1 wherein the thickness of the panel varies over the area of the panel to provide a range of bending stiffness and hence coincidence frequency.

5. A loudspeaker according to claim 1 wherein the bending stiffness has a maximum in the central region of the panel and decreases towards the edges.

6. A loudspeaker according to claim 5 wherein the exciter is coupled to the panel near the maximum of bending stiffness.

7. A loudspeaker according to claim 6 wherein the exciter is positioned at a maximum of bending stiffness of the panel.

8. A loudspeaker according to claim 1 wherein the panel stiffness has a minimum in the centre of the panel and increases towards the edges of the panel.

9. A loudspeaker according to claim 8 wherein the exciter is located near the centre of the panel in a region of lower stiffness than the average stiffness of the panel.

10. A loudspeaker according to claim 8 or 9 wherein at least one of the edges of the panel is clamped, and the bending stiffness of the panel is maximal at at least one clamped edge.

11. A loudspeaker according to claim 1 wherein the gradient of bending stiffness is concentrated near the exciter position.

12. A loudspeaker according to claim 11 wherein the gradient of bending stiffness is high close to the exciter position and slowly reduces along lines extending outwards from the exciter position.

13. A loudspeaker according to claim 1 wherein the bending stiffness varies around the edge of the panel.

14. A loudspeaker according to claim 13 wherein the bending stiffness is highest at the edges of the panel and smoothly falls towards the interior of the panel.

15. A loudspeaker according to claim 13 or 14 in which at least one edge is clamped to a support.

16. A loudspeaker according to claim 15 wherein the bending stiffness at the edge of the panel is such that the mechanical impedance of the panel at its edge mismatches that of the support.

17. A loudspeaker according to claim 1 wherein the bending stiffness of the panel varies in an undulating pattern so that the effect of coincidence on the acoustic output is smoothed.

18. A loudspeaker according to claim 1 wherein the panel is a distributed mode panel having a plurality of resonant bending wave modes distributed in frequency.

19. A loudspeaker comprising a panel capable of supporting resonant bending waves in the audio frequency range an exciter on the panel for exciting resonant bending waves in the panel to produce an acoustic output, wherein the coincidence frequency in the panel varies with position over the area of the panel over a length scale of at least one wavelength at coincidence, so that the effect of coincidence on the acoustic output of the panel is smoothed and wherein the bending stiffness varies over the panel area so that the coincidence frequency varies.

* * * * *